US011918173B2

(12) United States Patent
Li

(10) Patent No.: US 11,918,173 B2
(45) Date of Patent: Mar. 5, 2024

(54) DUST COLLECTION GUIDE STRUCTURE, DUST COLLECTION MECHANISM AND SWEEPING ROBOT

(71) Applicant: ZHEJIANG OUNITECH ROBOTICS CO., LTD., Zhejiang (CN)

(72) Inventor: Beichen Li, Guangdong (CN)

(73) Assignee: ZHEJIANG OUNITECH ROBOTICS CO., LTD., Ningbo (CN)

( * ) Notice: Subject to any disclaimer, the term of this patent is extended or adjusted under 35 U.S.C. 154(b) by 424 days.

(21) Appl. No.: 17/180,847

(22) Filed: Feb. 21, 2021

(65) Prior Publication Data

US 2021/0169288 A1 Jun. 10, 2021

Related U.S. Application Data

(63) Continuation of application No. PCT/CN2018/101600, filed on Aug. 21, 2018.

(51) Int. Cl.

| | |
|---|---|
| ***A47L 9/04*** | (2006.01) |
| ***A47L 5/22*** | (2006.01) |
| ***A47L 9/16*** | (2006.01) |

(52) U.S. Cl.

CPC ..... *A47L 9/0483* (2013.01); *A47L 5/22* (2013.01); *A47L 9/1683* (2013.01); *A47L 2201/00* (2013.01)

(58) Field of Classification Search

CPC ..... A47L 2201/00; A47L 9/0693; A47L 9/02; A47L 9/0461; A47L 9/06

See application file for complete search history.

(56) References Cited

U.S. PATENT DOCUMENTS

| | | | | |
|---|---|---|---|---|
| 9,622,633 | B2 * | 4/2017 | Kim | A47L 9/2852 |
| 2005/0076466 | A1 * | 4/2005 | Yan | A47L 5/28 15/319 |
| 2005/0278892 | A1 * | 12/2005 | Bosses | A47L 9/0072 15/364 |
| 2006/0248680 | A1 * | 11/2006 | Heidenga | A47L 9/04 15/387 |

FOREIGN PATENT DOCUMENTS

| | | | |
|---|---|---|---|
| CN | 1611174 | A | 5/2005 |
| CN | 205493720 | U | 8/2016 |
| CN | 105942926 | A | 9/2016 |
| CN | 105996899 | A | 10/2016 |
| CN | 106175588 | A | 12/2016 |
| CN | 106175589 | A | 12/2016 |
| CN | 206044540 | U | 3/2017 |
| EP | 2060219 | A3 | 4/2014 |

OTHER PUBLICATIONS

International Search Report of PCT Patent Application No. PCT/CN2018/101600 dated May 23, 2019.

* cited by examiner

*Primary Examiner* — Andrew A Horton

(57) ABSTRACT

A dust collection guide structure (10) arranged at the bottom (11) of a shell of a dust collection mechanism comprises an air duct suction opening (12) formed in the bottom (11) of the shell and at least one groove (13) formed in the surface of the bottom (11) of the shell. One end of each of the at least one groove (13) communicates with the air duct suction opening (12) to form a dust guide air duct for guiding dust into the air duct suction opening (12), and the other end is in smooth transition connection with the edge of the bottom (11) of the shell.

9 Claims, 23 Drawing Sheets

DUST COLLECTION GUIDE STRUCTURE, DUST COLLECTION MECHANISM AND SWEEPING ROBOT

CROSS-REFERENCE TO RELATED APPLICATIONS

The present application is a Continuation Application of PCT application No. PCT/CN2018/101600 filed on Aug. 21, 2018, the contents of which are hereby incorporated by reference.

FIELD OF THE PRESENT INVENTION

The invention relates to the field of robots, in particular to a dust collection guide structure, a dust collection mechanism and a sweeping robot.

BACKGROUND OF THE PRESENT INVENTION

A sweeping robot, also known as a cleaning robot, an intelligent dust collection robot, a robot dust collector and the like, is one of intelligent household appliances, and can automatically complete floor cleaning work in a room by means of certain artificial intelligence. The sweeping robot generally adopts a brush sweeping mode and a vacuum mode to absorb impurities on the ground and enter a garbage storage box thereof, so that the function of cleaning the ground is achieved. Generally speaking, a robot that performs cleaning, dust collection and floor wiping is collectively called a sweeping robot.

Currently, a common structure of a sweeping robot is shown in FIG. 1, the sweeping robot comprises a robot body 100, the robot body 100 comprises a face shell 101, a bottom shell 102 and a face cover (not shown), and the bottom shell 102 is sleeved and screwed to the bottom of the face shell 101. A universal wheel 104 is arranged at the front end of the bottom shell 102, a left driving wheel 105 and a right driving wheel 106 are respectively arranged on two sides of the middle part of the bottom shell 102, and the universal wheel 104, the left driving wheel 105 and the right driving wheel 106 are connected with a motor (not shown). An air suction opening 107 is formed between the left driving wheel 105 and the right driving wheel 106, a main brush 108 is arranged in the air suction opening 107, and the main brush 108 is a rolling brush, is in transmission connection with a rolling brush motor (not shown) and is driven by the rolling brush motor to rotate. The main brush 108 has a brush shaft 1081 and brush bristles 1082 extending outwardly from the outer wall surface of the brush shaft 1081. The brush shaft 1081 is driven by the rolling brush motor to rotate, and the brush bristles 1082 sweep the ground to raise dust during rotation of the brush shaft 1081. A dust collection box (not shown) communicated with the air suction opening 107 and a dust collection fan communicated with the dust collection box are arranged in the robot body 100. Under the action of the dust collection fan, dust raised by the main brush 108 is sucked into the dust collection box through the air suction opening 107.

A left side brush 1091 and a right side brush 1092 are arranged in front of the left driving wheel 105 and the right driving wheel 106 respectively, the left side brush 1091 and the right side brush 1092 are arranged to be three-blade type brush handles 10911 and 10921, and brush bristles 10912 and 10922 are installed on the brush handles. The left side brush 1091 and the right side brush 1092 are connected with side brush motors respectively and enable the brush handles 10911 and 10921 to rotate around their center shafts by 360 degrees under the driving action of the side brush motors respectively, and therefore the brush bristles 10912 and 10922 are driven to rotate so as to sweep dust on the ground and suck the dust into the dust collection box through the air suction opening 107.

The present inventor finds that the prior art has at least any of the following technical drawbacks during the practice of the present invention:

1, the sweeping function of the sweeping robot needs to be achieved by arranging a rolling main brush in the center and arranging rotate side brushes on the periphery in a matched mode, and therefore the sweeping range of the sweeping robot is enlarged; however, the rolling main brush and the side brushes are driven by independent motors, and the cost is high.

2, the rolling main brush is arranged in the air suction opening for cleaning, the rolling main brush is easy to wind hairs on the ground in the rotating process, the air suction opening is blocked due to the winding of the hairs after long-term use, the dust suction and cleaning effects are influenced, and the normal use of the sweeper is influenced; and the service life of the sweeper is shortened because the main brush is severely blocked. The hairs on the rolling main brush needs to be manually cleaned regularly, and inconvenience is brought to a user due to troublesome cleaning.

3, the three-blade type 360-degree rotating side brush is easy to wind hairs, and the problem like the rolling main brush is caused by hair winding in the long-term use process; in addition, the design of the length of bristles of a rotating side brush is a difficult problem, corners cannot be swept due to the fact that the bristles are too short, and the driving wheels on the two sides are prone to being pressed due to the fact that the bristles are too long, so that the driving wheels slip and the like.

SUMMARY OF THE PRESENT INVENTION

An embodiment of the present invention aims to provide a dust collection guide structure, a dust collection mechanism and a sweeping robot, which can effectively solve the problems of dust collection blockage and the like caused by winding due to arrangement of a rolling main brush in an air duct suction opening in the prior art, and effectively improve the dust suction efficiency and effect.

In order to achieve the purpose, the embodiment of the present invention provides a dust collection guide structure which is arranged at a bottom of the shell of a dust collection mechanism and comprises an air duct suction opening formed in the bottom of the shell and at least one groove formed in the surface of the bottom of the shell, and each of the at least one groove is communicated with the air duct suction opening to form a dust guide air duct for guiding dust into the air duct suction opening.

Preferably, one end of each of the at least one groove is connected with the air duct suction opening, and the other end of each of the at least one groove is in smooth transition connection with an edge of the bottom of the shell.

Preferably, the at least one groove formed in the surface of the bottom of the shell comprises one groove, and the one groove is formed between a front end of the surface of the bottom of the shell and the air duct suction opening.

Preferably, the at least one groove formed in the surface of the bottom of the shell comprises two grooves, and the two grooves are formed in two sides of the air duct suction opening respectively.

Preferably, the two grooves integrally form a straight line shape, a splayed shape or an inverted splayed shape.

Preferably, the at least one groove formed in the surface of the bottom of the shell comprises pluralities of grooves, and the pluralities of grooves are: radially formed in a front end of the surface of the bottom of the shell; formed in the front end of the surface of the bottom of the shell in parallel; formed in two sides of the air duct suction opening in parallel; or radially formed in two sides of the air duct suction opening.

Preferably, the air duct suction opening is shaped as a circle, an ellipse, a triangle, a quadrilateral, an irregular polygon, or an approximate ellipse with a rectangular middle part and semicircular sides.

Preferably, the air duct suction opening is shaped as a polygon, and one end of each of the at least one groove is correspondingly connected with one edge of the air duct suction opening.

Preferably, the at least one groove formed in the surface of the bottom of the shell comprises two or more grooves, the shape of the air duct suction opening is matched with that of the two or more grooves, and one end of each of the two or more grooves is correspondingly connected with one edge of the air duct suction opening.

Preferably, the air duct suction opening is rectangular, the at least one groove formed in the surface of the bottom of the shell comprises a first groove and a second groove, and one end of the first groove and one end of the second groove are connected with a left short edge and a right short edge of the air duct suction opening respectively.

Preferably, a width of the one end of the first groove and a width of the one end of the second groove are equal to a length of the left short edge and a length of the right short edge of the air duct suction opening.

Preferably, the at least one groove formed in the surface of the bottom of the shell further comprises a third groove, a front end of the third groove is in smooth transition connection with an edge of a front end of the bottom of the shell, and a rear end of the third groove is connected with a front edge of the air duct suction opening.

Preferably, a width of the rear end of the third groove is less than or equal to a length of the front edge of the air duct suction opening.

Preferably, a depth of each of the at least one groove is gradually increased from one end away from the air duct suction opening to the other end connected with the air duct suction opening.

Preferably, the air duct suction opening is formed in a central axis of the bottom of the shell, and a distance between the air duct suction opening and a front end of the bottom of the shell is smaller than a distance between the air duct suction opening and a rear end of the bottom of the shell.

Preferably, an inclined guide surface is arranged at a front end of the bottom of the shell, and an included angle theta between the inclined guide surface and a horizontal plane is more than 0 degree and less than 45 degrees.

Preferably, the included angle theta between the inclined guide surface and the horizontal plane is more than 5 degrees and less than 45 degrees.

Preferably, the included angle theta between the inclined guide surface and the horizontal plane is more than 10 degrees and less than 20 degrees.

Preferably, a front or rear edge of the air duct suction opening abuts a rear end of the inclined guide surface.

Preferably, each of the at least one groove is disposed on the inclined guide surface.

Preferably, the at least one groove formed in the surface of the bottom of the shell comprises a first groove and a second groove, the first groove and the second groove are formed in two sides of the air duct suction opening respectively, and front edges or rear edges of the first groove and the second groove abut the rear end of the inclined guide surface.

Preferably, the at least one groove formed in the surface of the bottom of the shell further comprises a third groove, a front end of the third groove is in smooth transition connection with the front end of the bottom of the shell, and a rear end of the third groove is connected with the air duct suction opening.

Preferably, the inclined guide surface comprises a first inclined guide surface and a second inclined guide surface which are connected in a front-to-back transition manner, and an included angle between the first inclined guide surface and a horizontal plane is larger than an included angle between the second inclined guide surface and the horizontal plane.

Preferably, the third groove is formed in the second inclined guide surface, the front end of the third groove is in smooth transition connection with a rear end of the first inclined guide surface, and the rear end of the third groove is connected with the air duct suction opening.

Preferably, the inclined guide surface is a curved surface, and the angle theta between the inclined guide surface and the horizontal plane gradually decreases from the front end to the rear end of the inclined guide surface.

Preferably, the second inclined guide surface is further provided with a first sweeping brush and a second sweeping brush, and the first sweeping brush and the second sweeping brush are arranged in front of the first groove and the second groove respectively and arranged on two sides of the third groove.

Preferably, the first sweeping brush is disposed parallel to the first groove and the second sweeping brush is disposed parallel to the second groove.

Preferably, each of the first sweeping brush and the second sweeping brush moves back and forth in a direction of an axis thereof.

Preferably, each of the first sweeping brush and the second sweeping brush moves back and forth in a direction perpendicular to an axis thereof.

Preferably, each of the first sweeping brush and the second sweeping brush swings back and forth around an axis thereof.

Preferably, the swing range of each of the first sweeping brush and the second sweeping brush swinging back and forth around the axis thereof is 120°.

Preferably, each of the first sweeping brush and the second sweeping brush rotates 360° around an axis thereof.

Preferably, each of the first sweeping brush and the second sweeping brush comprises at least one row of bristles, each of the least one row of bristles comprising pluralities of bristle bundles.

Preferably, each of the least one row of bristles extends out of a surface of the bottom of the shell abut against ground.

Preferably, an upper surface of each of the least one row of bristles is in a same horizontal plane to be flush with the ground.

Preferably, each of the at least one groove is integrally formed with the air duct suction opening.

Preferably, the dust collection guide structure further comprises a baffle arranged on a rear edge of the air duct suction opening.

Preferably, the dust collection guide structure further comprises baffles, the baffles comprise a middle baffle arranged on a rear edge of the air duct suction opening, and a left baffle and a right baffle which are connected to a left side and a right side of the middle baffle respectively, and the left baffle and the right baffle are arranged on rear edges the two grooves respectively.

Preferably, the dust collection guide structure further comprises at least one sweeping brush independently arranged at the bottom of the shell and separated from the air duct suction opening.

Preferably, each of the at least one sweeping brush is driven to do reciprocating circulating movement close to and away from the air duct suction opening.

Preferably, each of the at least one sweeping brush is driven to do reciprocating circulating movement between the air duct suction opening and en edge of the bottom of the shell.

Preferably, the at least one sweeping brush is matched with the at least one groove so as to facilitate guiding raised dust into the air duct suction opening through the at least one groove.

Preferably, the at least one groove formed in the surface of the bottom of the shell comprises a first groove and a second groove which are formed in two sides of the air duct suction opening respectively, and the at least one sweeping brush arranged at the bottom of the shell comprises a first sweeping brush and a second sweeping brush which are arranged in front of the first groove and the second groove respectively.

Preferably, the first sweeping brush is disposed parallel to the first groove and the second sweeping brush is disposed parallel to the second groove.

Preferably, the first groove and the second groove each comprises pluralities of sub-grooves arranged in parallel, the first sweeping brush and the second sweeping brush each comprises pluralities of sweeping sub-brushes arranged in parallel, and the pluralities of sub-grooves and the pluralities of sweeping sub-brushes are arranged alternately.

Preferably, the first groove and the second groove integrally form a straight line, a splayed shape, or an inverted splayed shape.

Preferably, the at least one groove is disposed between a front end of the surface of the bottom of the shell and the air duct suction opening, and the at least one sweeping brush and the at least one groove are arranged in parallel.

Preferably, the at least one groove comprises at least two grooves, and the at least two grooves are arranged between the front end of the surface of the bottom of the shell and the air duct suction opening in parallel, and the at least one sweeping brush and the at least two grooves are arranged alternately.

Preferably, the at least one groove comprises pluralities of grooves, the pluralities of grooves are radially formed in the front end of the surface of the bottom of the shell, the at least one sweeping brush comprises pluralities of sweeping brushes, and the pluralities of sweeping brushes and the pluralities of grooves are arranged alternately.

Preferably, each of the at least one sweeping brush moves back and forth in a direction of an axis thereof.

Preferably, each of the at least one sweeping brush moves back and forth in a direction perpendicular to an axis thereof.

Preferably, each of the at least one sweeping brush swings back and forth around an axis thereof.

Preferably, a swing range of each of the at least one sweeping brush swinging back and forth around the axis thereof is 120°.

Preferably, each of the at least one sweeping brush rotates 360° around an axis thereof.

Preferably, each of the at least one sweeping brush comprises a fixed seat arranged at the bottom of the shell, a movable support arranged on the fixed seat and bristles arranged on the movable support, and the movable support is driven by a driving component to move relative to the fixed seat.

Preferably, the movable support is driven by the driving component to move relative to the fixed seat as follows: moving back and forth in a direction of an axis thereof; or moving back and forth in a direction perpendicular to an axis thereof.

Preferably, the movable support is further driven by a driving component to move relative to the fixed seat as follows: swinging back and forth around an axis thereof, and a swinging range is 120° or rotating 360° around an axis thereof.

Preferably, the movable support is driven by a driving component to move up and down away from or close to a horizontal plane where the fixed seat is located.

Preferably, the fixed seat comprises a limiting body, a containing groove is formed in the limiting body, the movable support comprises a movable body used for containing bristles, a driven member is arranged at a bottom of the movable body, and the driven member extends out of the containing groove and drives the movable body to move back and forth in the containing groove under an action of the driving component.

Preferably, the driving component comprises a motor and a coupling member driven by the motor, and the coupling member is connected with the driven member in a matched manner.

Preferably, the motor is a brushed direct current motor or a brushless direct current motor, and the coupling member is an eccentric shaft.

Preferably, the movable body reciprocates in a length direction in the containing groove; a length of the movable body is smaller than that of the containing groove; the movable body comprises an upper portion for arranging bristles and a lower portion connected with the upper portion, and the driven member is arranged on a bottom surface of the lower portion; a longitudinal section of the movable body in a width direction of the movable body is in a convex shape; a width of the upper portion is smaller than that of the containing groove so that the upper portion can be contained in the containing groove, and a width of the lower portion is larger than that of the containing groove.

Preferably, the movable body reciprocates in a width direction in the containing groove; a width of the movable body is smaller than that of the containing groove; the movable body comprises an upper portion for arranging bristles and a lower portion connected with the upper portion, and the driven member is arranged on a bottom surface of the lower portion; a longitudinal section of the movable body in a length direction of the movable body is in a convex shape; a length of the upper portion is smaller than that of the containing groove so that the upper portion can be contained in the containing groove, and a length of the lower portion is larger than that of the containing groove.

Preferably, the bristles are mainly formed by arranging pluralities of bristle bundles.

Preferably, the movable support provided on each fixed seat comprises pluralities; and/or the bristles arranged on each movable support comprise pluralities of rows.

Preferably, each of the pluralities of rows of the bristles extends out of a surface of the bottom of the shell to abut against ground.

Preferably, an upper surface of each of the pluralities of rows of the bristles is in a same horizontal plane to be flush with the ground.

Preferably, each of the pluralities of bristle bundles rotates 360° around a center of circle thereof.

Preferably, the bottom of the shell is in a disc-like shape with a front end edge being a straight line section.

Preferably, the dust collection guide structure further comprises a side brush disposed on at least one corner of a front end of the bottom of the shell, the side brush rotating when driven by a drive device.

The embodiment of the present invention further provides a dust collection mechanism which comprises the dust collection guide structure of any embodiment and further comprises a dust collection box and a draught fan which are arranged inside a shell, and the air duct suction opening, the dust collection box and the draught fan are sequentially communicated.

Preferably, the draught fan comprises a first draught fan and a second draught fan, and the first draught fan and the second draught fan communicate with the dust collection box through an air suction guide component; the air suction guide component comprises a first air suction channel and a second air suction channel which are independent of each other, the first draught fan is communicated with the first air suction channel, and the second draught fan is communicated with the second air suction channel.

The embodiment of the present invention further provides a sweeping robot which comprises the dust collection mechanism of any embodiment.

Compared with the prior art, the embodiment of the present invention has at least the following technical effects:

(1) at least one groove is formed in the surface of the bottom of the shell, and each of the at least one groove is communicated with the air duct suction opening to form a dust guide air duct for guiding dust into the air duct suction opening, so that the dust on the ground is favorably guided and sucked into the air duct suction opening, and the dust suction efficiency is improved. In addition, the dust guide air duct is adopted to replace a rolling main brush arranged in the air suction opening, and the problems that winding caused by the rolling main brush blocks the air suction opening, and the sweeping effect of the dust suction box is affected can be effectively avoided.

(2) the sweeping brush matched with the groove is arranged at the bottom of the shell, so that the dust raised by the sweeping brush is further favorably guided into the air duct suction opening through the groove, and the dust suction efficiency is improved; besides, the sweeping brush is arranged at the bottom of the shell and is separated from the air duct suction opening to be independently arranged, the dust collection efficiency can be more effectively improved, and the problem that the sweeping effect of the dust collection box is affected due to the fact that the sweeping brush is wound to block the air duct suction opening after being used for a long time can be avoided.

(3) at least one groove is formed in the surface of the bottom of the shell, and rotary side brushes are arranged on at least one corner (preferably the left corner and the right corner) of the front end of the bottom of the shell in a matched mode, so that the problem that the sweeping effect of the dust collection box is affected due to the fact that the air dust suction opening is blocked by winding of a rolling main brush arranged on the air duct suction opening can be effectively avoided; and dust raised by the side brushes can be guided into the air duct suction opening through the groove, so that the dust suction efficiency is improved, and particularly, the sweeping and cleaning effects on corners are very ideal.

(4) the sweeping brush arranged at the bottom of the shell integrally performs reciprocating circulating movement close to and far away from the air duct suction opening when being driven to sweep, so that dust raised by sweeping is favorably sucked into the air duct suction opening in the moving process, and the sweeping effect and the dust collection effect are improved.

(5) the sweeping brush arranged at the bottom of the shell integrally does reciprocating circulating movement between the air duct suction opening and the edge of the bottom of the shell when being driven, and the sweeping brush is used for sweeping dust at the center and the edge of the sweeping robot in the moving process, namely, the sweeping brush provided by the embodiment of the present invention can serve as a main brush and a side brush in the moving process at the same time, the sweeping range of the sweeping robot can be widened, the cost can be reduced, the main brush, the side brush and corresponding drivers do not need to be arranged respectively, and the cost is lower.

(6) the movable sweeping brush integrally doing reciprocating circulation movement between the air duct suction opening and the edge of the bottom of the shell is adopted to replace a rotary side brush to sweep the area around the sweeping robot, and the problems that hair is wound and a driving wheel slips and the like due to an existing rotary side brush is used can be effectively solved.

(7) the inclined guide surface is arranged between the air duct suction opening and the edge of the front end of the bottom of the shell, so that the obstacle crossing function can be achieved, dust at the front end of the sweeping robot can be further guided and sucked into the air duct suction opening, and the dust suction efficiency is improved.

(8) the inclined guide surface between the air duct suction opening and the front end edge of the bottom of the shell is set to be a first inclined guide surface and a second inclined guide surface which are in front-back transition connection, and the included angle between the first inclined guide surface and the horizontal plane is larger than that between the second inclined guide surface and the horizontal plane. Thus, the included angle between the first inclined guide face and the horizontal plane is larger, the obstacle crossing function is improved, the included angle between the second inclined guide face closer to the air duct suction opening and the horizontal plane is smaller, the closer the air duct suction opening is, the larger the suction force is, and dust suction is facilitated.

and (9) the inclined guide surface between the air duct suction opening and the edge of the front end of the bottom of the shell is set to be a curved surface, and the included angle theta between the inclined guide surface and the horizontal plane is gradually reduced from the front end of the inclined guide surface to the rear end of the inclined guide surface. Thus, the included angle theta between the inclined guide face close to the edge of the front end of the bottom of the shell and the horizontal plane is larger, the obstacle crossing function is better improved, the included angle theta between the inclined guide face close to the air duct suction opening and the horizontal plane is smaller, the closer the air duct suction opening is, the larger the suction force is, and dust suction is better facilitated.

DETAILED DESCRIPTION OF ILLUSTRATED EMBODIMENTS

Figure 1:
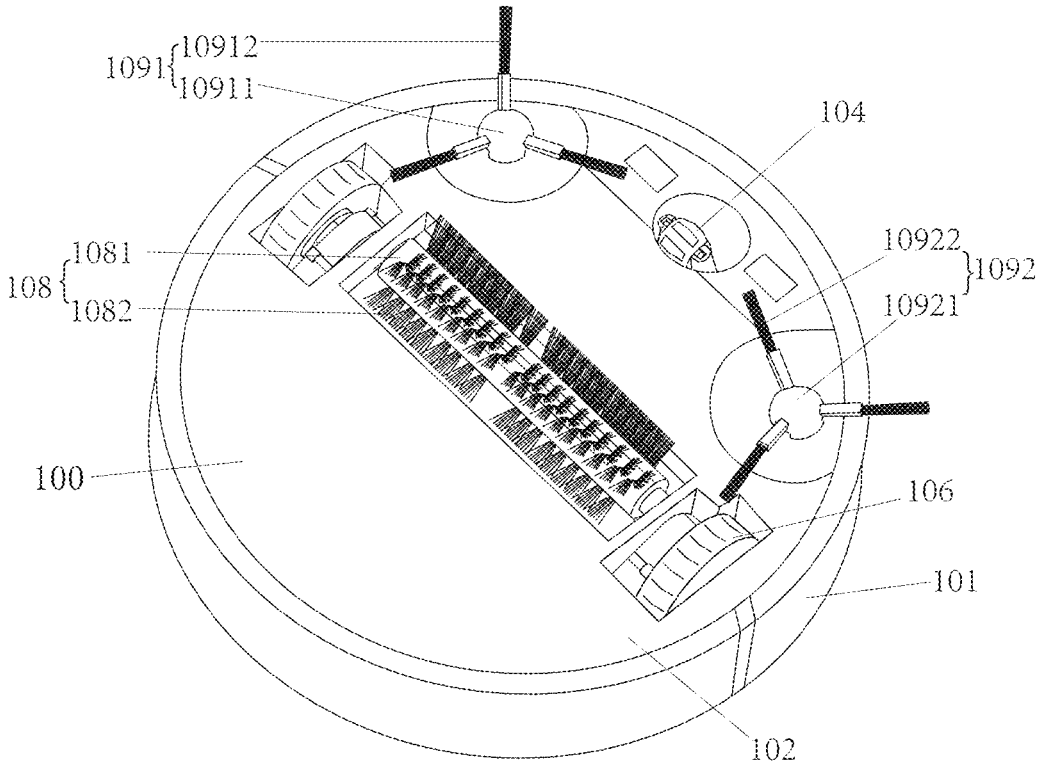
FIG.1 (Prior Art)
FIG. 1 is a schematic structural view of a sweeping robot employed in the prior art.

Technical solutions in embodiments of the present invention will be described clearly and fully hereinafter in connection with the accompanying drawings in embodiments of the present invention, and obviously, the described embodiments are only a part of, and not all, embodiments of the present invention. Based on the embodiments of the present invention, all other embodiments obtained by one of ordinary skill in the art without creative work fall within the scope of the present invention.

In the description of the present invention, it is to be understood that the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise", and the like, indicate orientations or positional relationships based on those shown in the drawings, merely for convenience of description and simplification of the description, and do not indicate or imply that the device or element referred to must have a particular orientation, be constructed in a particular orientation, and be operated, and thus, are not to be construed as limiting the present invention.

Furthermore, the terms "first", "second" are used for descriptive purposes only and are not to be construed as indicating or implying relative importance or to implicitly indicate the number of technical features indicated. Thus, a feature defined as "first" or "second" may explicitly or implicitly include one or more of that features. In the description of the present invention, "pluralities" means at least two, e.g., two, three, etc., unless explicitly specified otherwise.

In the present invention, unless expressly specified and limited otherwise, the terms "installed", "jointed", "connected", "fixed" and the like are to be construed broadly, e.g., as being permanently connected, detachably connected, or integral; may be mechanically, electrically or otherwise in communication with each other; they may be directly connected or indirectly connected through intervening media, or may be connected through the use of two elements or the interaction of two elements. The specific meanings of the above terms in the present invention can be understood according to specific situations by those of ordinary skill in the art.

Example 1

Referring to FIGS. 2A-2D, an embodiment of the present invention provides a sweeping robot. A dust collection mechanism is arranged on the sweeping robot and comprises a dust collection guide structure 10 arranged at the bottom of a shell 1, a dust collection box 2 and a draught fan 3, the dust collection box 2 and the draught fan 3 are arranged in the shell 1, and an inlet 20 of the dust collection box 2 is communicated with an air duct suction opening 12 of the dust collection guide structure at the bottom of the shell 1.

An outlet (not shown) of the dust collection box 2 is communicated with an inlet 30 of the draught fan 3.

The draught fan 3 comprises a first draught fan 31 and a second draught fan 32, and the first draught fan 31 and the second draught fan 32 are communicated with the dust collection box 2 through an air suction guide component 33. The air suction guide component 33 comprises a first air suction channel 331 and a second air suction channel 332 which are independent of each other, the first draught fan 31 is communicated with the first air suction channel 331, and the second draught fan 32 is communicated with the second air suction channel 332. The air suction guide component 33 is provided with a partition plate 333 at the position, close to an inlet 30 of the draught fan 3, of the first air suction channel 331 and the second air suction channel 332, and therefore the first air suction channel 331 and the second air suction channel 332 are separated to be independent of each other.

The dust collection guide structure 10 provided by the embodiment of the present invention is arranged at the bottom 11 of the shell 1 of the dust collection mechanism and comprises an air duct suction opening 12 formed in the bottom 11 of the shell 1 and at least one groove 13 formed in the surface of the bottom 11 of the shell 1, and each of the at least one groove 13 is communicated with the air duct suction opening 12 to form a dust guide air duct for guiding dust into the air duct suction opening 12.

Figure 2A:
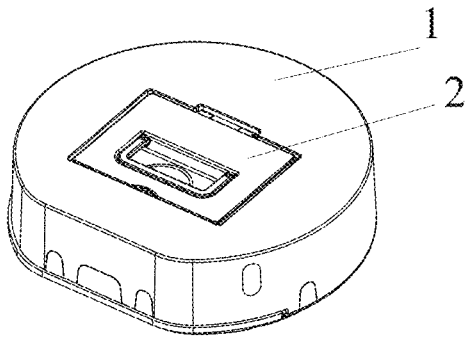
FIGS. 2A-2D are schematic structural views of a sweeping robot and a dust collection guide structure thereof provided in Example 1 of the present invention.
Figure 2B:
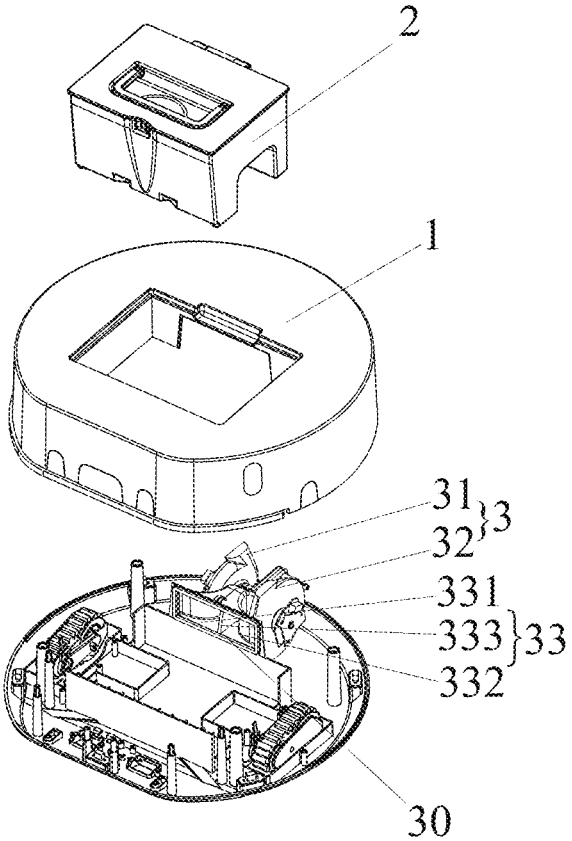
Figure 2C:
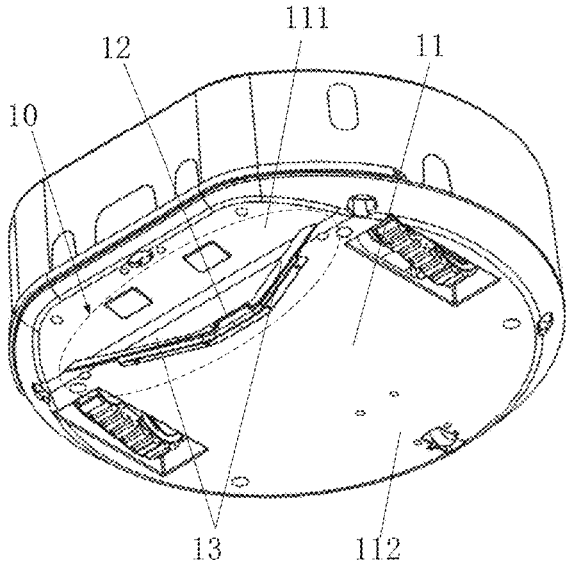
Figure 2D:
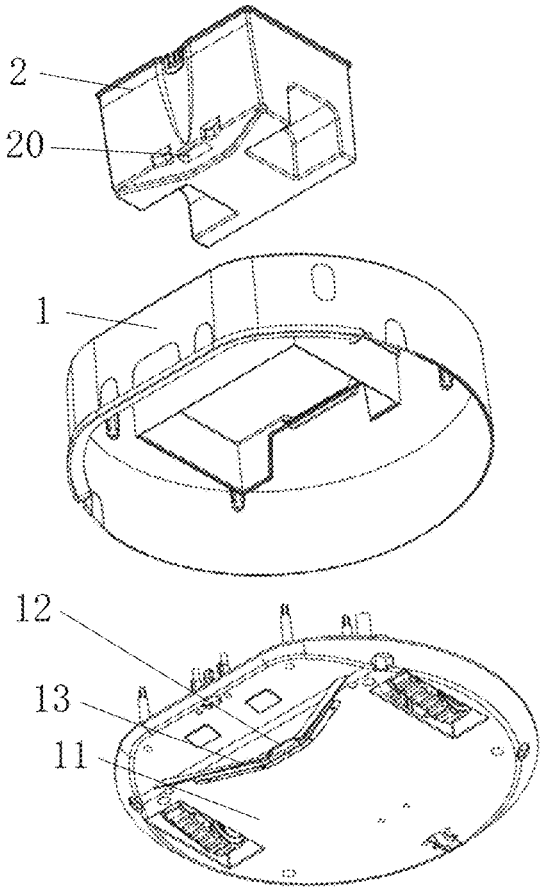
Figure 2E:
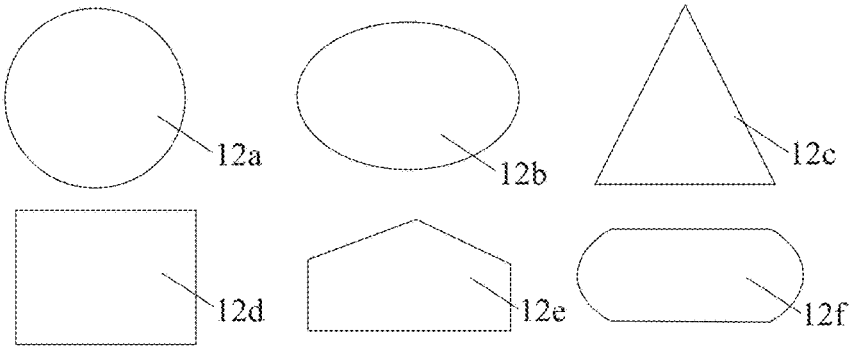
FIG. 2E shows embodiments of various alternative shapes of an air duct suction opening of the dust collection guide structure provided in Example 1 of the present invention.

The bottom 11 of the shell 1 is in a disc-like shape with the front end edge being a straight line section. Preferably, the air duct suction opening 12 is formed in the central axis of the bottom 11 of the shell 1, and the distance between the air duct suction opening 12 and the front end 111 of the bottom 11 of the shell 1 is smaller than the distance between the air duct suction opening 12 and the rear end 112 of the bottom 11 of the shell 1. It will be appreciated that the air duct suction opening 12 may be shaped as a circle 12*a*, an ellipse 12*b*, a triangle 12*c*, a quadrilateral 12*d*, or an irregular polygon 12*e*, as shown in FIG. 2E; or the air duct suction opening 12 is shaped as an approximate ellipse 12*f* with a rectangular middle part and semicircular sides, and the like. Each of the at least one groove 13 is shaped to match the shape of the air duct suction opening 12 for connection. Specifically, one end 131 of each of the at least one groove 13 is connected with the air duct suction opening 12, and the other end 132 of each of the at least one groove 13 is in smooth transition connection with the edge of the bottom 11 of the shell 1. Each of the at least one groove 13 and the air duct suction opening 12 can be integrally formed.

The sweeping robot disclosed by the embodiment of the present invention comprises a dust collection mechanism, the dust collection mechanism guides sucked dust into an air duct suction opening through at least one groove arranged on the surface of the bottom of the shell as a dust guide air duct under the suction action of a draught fan 3 in the shell 1 and in cooperation with a dust collection guide structure 10 on the bottom of the shell 1, and the dust enters the dust collection box through the air duct suction opening, so that the function of cleaning the ground is completed.

Therefore, according to the sweeping robot disclosed by the embodiment of the present invention, at least one groove is formed in the surface of the bottom of the shell, and each of the at least one groove is communicated with the air duct suction opening to form the dust guide air duct for guiding dust into the air duct suction opening, so that the dust on the ground can be conveniently guided and sucked into the air duct suction opening, and the dust suction efficiency is improved. In addition, the dust guide air duct is adopted to replace the existing air suction opening provided with a rolling main brush, so that the problem that the cleaning effect of the dust suction box is influenced due to the fact that the air suction opening is blocked by winding caused by the rolling main brush can be effectively solved.

Hereinafter, it will be described in detail, by way of a number of embodiments, that the dust collection guide structure 10 of the present invention may employ alternative specific structures and principles of operation.

Example 2

Referring to FIGS. 3A-3D, a dust collection guide structure provided by the embodiment of the present invention is arranged at the bottom 11 of the shell 1 of the dust collection mechanism and comprises an air duct suction opening 12 formed in the bottom 11 of the shell 1 and a groove 13 formed between the front end of the surface of the bottom 11 of the shell 1 and the air duct suction opening 12, and the groove 13 is communicated with the air duct suction opening 12 to form a dust guide air duct for guiding dust into the air duct suction opening 12.

Specifically, the front end 131 of the groove 13 is in smooth transitional connection with the edge of the front end of the bottom 11 of the shell 1, the rear end 132 of the groove 13 is connected with the front edge 121 of the air duct suction opening 12, the depth of the groove 13 is gradually increased from the front end 131 to the rear end 132 of the groove 13, and the width D1 of the rear end 132 of the groove 13 is smaller than or equal to the length of the front edge 121 of the air duct suction opening 12. This facilitates the introduction of dust into the duct suction opening 12. Besides, a baffle 120 extending upwards is arranged on the rear edge 122 of the air duct suction opening 12, the baffle 120 is arranged on the rear edge 122 of the air duct suction opening 12, raised dust and paper scraps can be blocked, and the situation that the dust and the paper scraps diffuse to the position behind the air duct suction opening 12 and cannot be sucked into the air duct suction opening 12 is avoided.

Figure 3A:
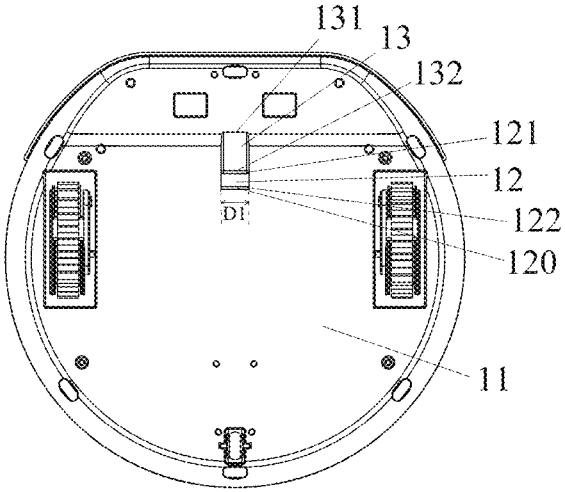
FIGS. 3A-3C are schematic structural views of a dust collection guide structure provided in Example 2 of the present invention.
Figure 3B:
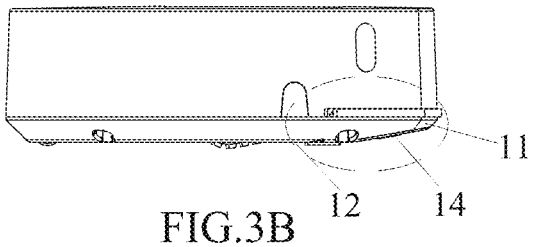
Figure 3C:
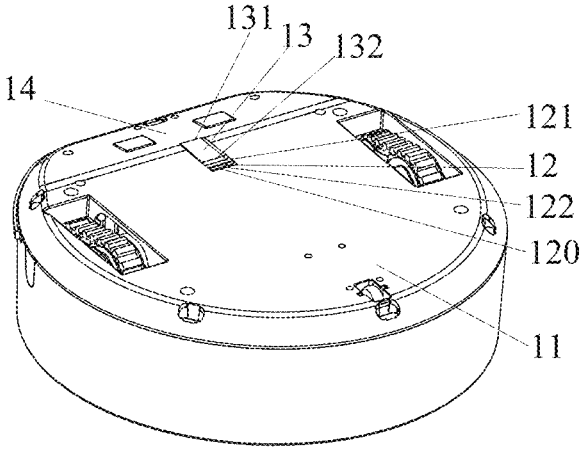
Figure 3D:
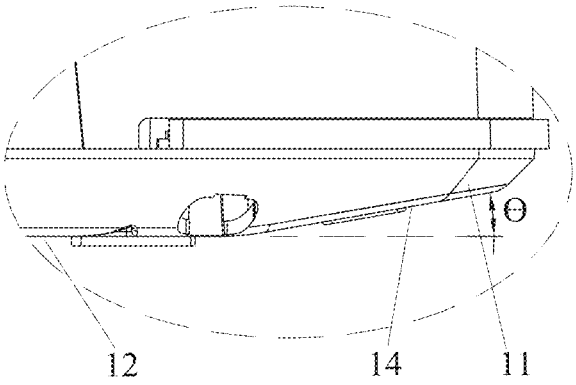
FIG. 3D is a partially enlarged view of the schematic structural view of the sweeping mechanism provided in Example 2 of the present invention shown in FIG. 3B.

In the embodiment, as shown in FIG. 3B-3D, an inclined guide surface 14 is arranged at the front end of the bottom of the shell, and the front edge 121 or the rear edge 122 of the air duct suction opening 12 abuts the rear end of the inclined guide surface 14. The included angle theta between the inclined guide surface and the horizontal plane is more than 0 degree and less than 45 degrees. Preferably, the included angle theta between the inclined guide surface 14 and the horizontal plane is more than 5 degrees and less than 30 degrees. More preferably, the included angle theta between the inclined guide surface and the horizontal plane is more than 10 degrees and less than 20 degrees. The groove 13 is arranged on the inclined guide surface 14.

According to the embodiment, the inclined guide surface 14 is arranged between the air duct suction opening 12 and the front end edge of the bottom 11 of the shell 1, the inclined guide surface 14 can achieve the obstacle crossing function and is beneficial to dust guide, and the groove 13 arranged on the inclined guide surface 14 is matched to further guide and suck dust in front of the sweeping robot into the air duct suction opening 12, so that the dust suction efficiency is improved.

Figure 4A:
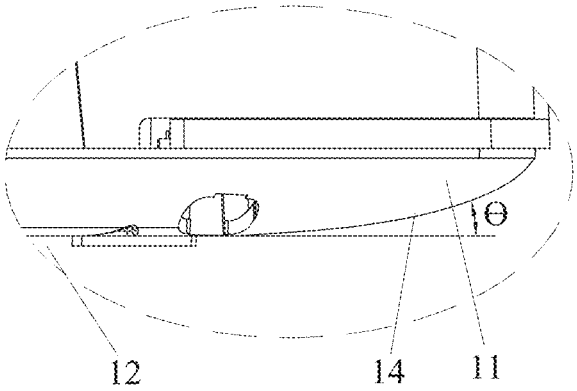
FIG. 4A is a schematic view of a preferred embodiment of an inclined guide surface of the dust collection guide structure provided in Example 2 of the present invention.

In a preferred embodiment, as shown in FIG. 4A, the inclined guide surface 14 itself is a curved surface, and the included angle theta between the inclined guide surface 14 and the horizontal plane is gradually reduced from the front end to the rear end of the inclined guide surface 14. According to the embodiment, the inclined guide surface 14 between the air duct suction opening and the edge of the front end of the bottom of the shell is arranged as a curved surface, and the included angle theta between the inclined guide surface and the horizontal plane is gradually reduced from the front end to the rear end of the inclined guide surface 14. Thus, the included angle theta between the inclined guide surface close to the edge of the front end of the bottom of the shell and the horizontal plane is larger, the obstacle crossing function is better improved, the included angle theta between the inclined guide face close to the air duct suction opening and the horizontal plane is smaller, the closer the air duct suction opening is, the larger the suction force is, and dust suction is better facilitated.

Figure 4B:
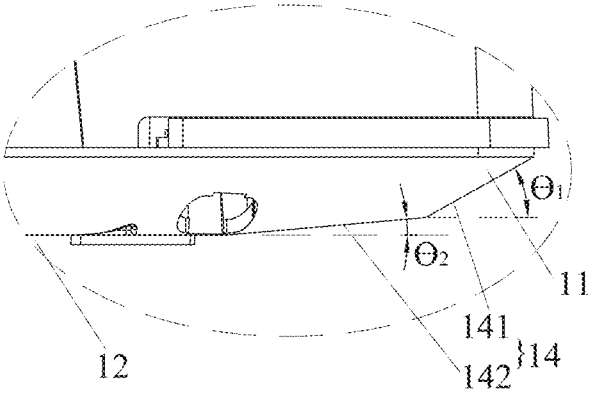
FIG. 4B is a schematic view of another preferred embodiment of the inclined guide surface of the dust collection guide structure provided in Example 2 of the present invention.

In another preferred embodiment, as shown in FIG. 4B, the inclined guide surface 14 comprises a first inclined guide surface 141 and a second inclined guide surface 142 which are connected in a front-to-back transition manner, and the included angle theta 1 between the first inclined guide surface 141 and the horizontal plane is larger than the included angle theta 2 between the second inclined guide surface 142 and the horizontal plane. According to the embodiment, the inclined guide surface 14 between the air duct suction opening 12 and the front end edge of the bottom 11 of the shell 1 is set to be the first inclined guide surface 141 and the second inclined guide surface 142 which are connected in a front-to-back transition manner, and the included angle theta 1 between the first inclined guide surface 141 and the horizontal plane is larger than the included angle theta 2 between the second inclined guide surface 142 and the horizontal plane. Thus, the included angle between the first inclined guide surface 141 and the horizontal plane is larger, which is beneficial to improving the obstacle crossing function, and the included angle between the second inclined guide surface 142 close to the air duct suction opening and the horizontal plane is smaller, so that the suction force near the air duct suction opening is larger, which is beneficial to sucking dust.

It can be understood that when the dust collection guide structure of Example 2 adopts the structure of the inclined guide surface 14 shown in FIG. 4B, the groove 13 can be formed in the second inclined guide surface 142, the front end 131 of the groove 13 is in smooth transition connection with the rear end of the first inclined guide surface 141, and the rear end 132 of the groove 13 is connected with the air duct suction opening 12.

Example 3

Figure 5A:
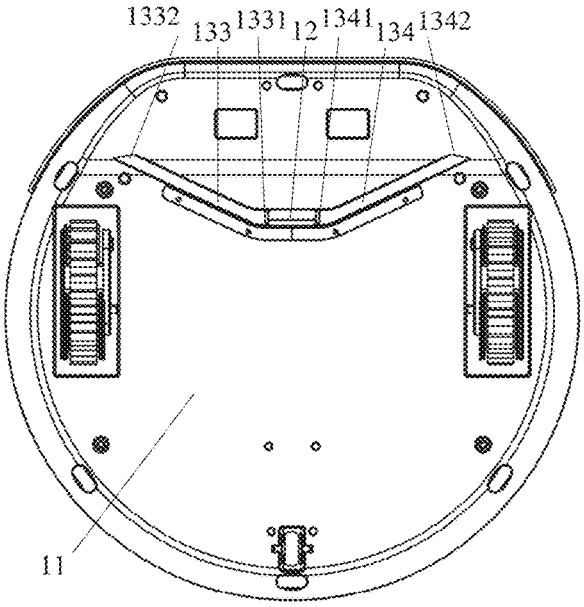
FIGS. 5A-5C are schematic structural views of a dust collection guide structure provided in Example 3 of the present invention.
Figure 5B:
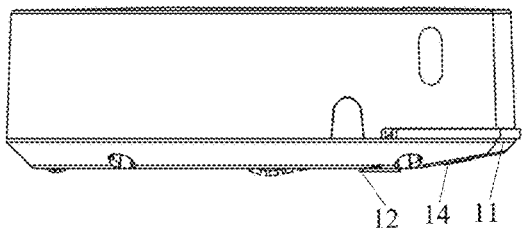
Figure 5C:
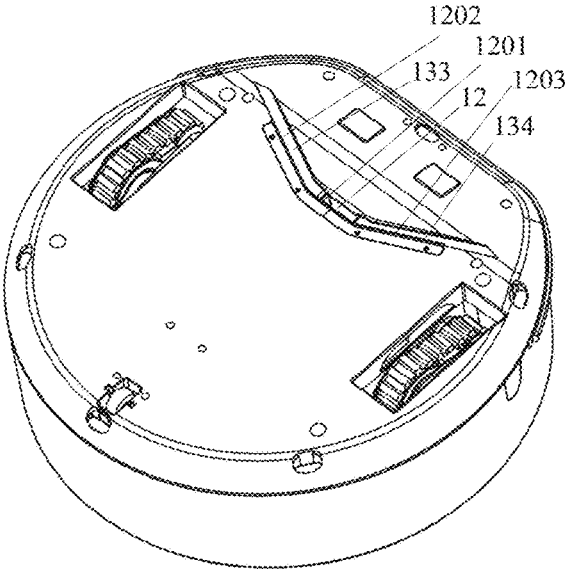

Referring to FIGS. 5A-5C, a dust collection guide structure provided by the embodiment of the present invention is arranged at a bottom 11 of the shell 1 of a dust collection mechanism and comprises an air duct suction opening 12 formed in the bottom 11 of the shell 1, and a first groove 133 and a second groove 134 which are formed in two sides of the air duct suction opening 12. The first groove 133 and the second groove 133 are each communicated with the air duct suction opening 12 to form a dust guide air duct for guiding dust into the air duct suction opening 12.

Specifically, one end 1331 of the first groove 133 is connected with the air duct suction opening 12, and the other end 1332 of the first groove 133 is in smooth transition connection with the edge of the bottom 11 of the shell 1. One end 1341 of the second groove 134 is connected with the air duct suction opening 12, and the other end 1342 of the second groove 134 is in smooth transition connection with the edge of the bottom 11 of the shell 1. The air duct suction opening 12 is rectangular, the one end 1331 of the first groove 133 and the one end 1341 of the second groove 134 are connected with the left short edge and the right short edge of the air duct suction opening respectively, and the width of the one end 1331 of the first groove 133 and the width of the one end 1341 of the second groove 134 are equal to the length of the left short edge and the length of the right short edge of the air duct suction opening 12 respectively. The depth of the first groove 133 is gradually increased from the one end 1332 to the other end 1331 of the first groove 133, the depth of the second groove 134 is gradually increased from the one end 1342 to the other end 1341 of the second groove 134, such a design facilitates the direction of dust and makes it easier for dust to be drawn into the air duct suction opening 12 via the first groove 133 and the second groove 134. Preferably, the first groove 133 and the second groove 134 are integrally formed in an inverted splayed shape, that is, the one end 1331 of the first groove 133 and the one end 1341 the second groove 134 are connected with the air duct suction opening in the middle front part of the bottom of the shell, and the other end 1332 of the first groove 133 and the other end 1341 of the second groove 134 are in smooth transition connection with the edges of the left and right corners of the bottom of the shell respectively.

In addition, the dust collection guide structure of the present embodiment may also be provided with an inclined guide surface 14, and the front or rear edges of the first and second grooves 133, 134 abut the rear end of the inclined guide surface 14. The specific structure and principle of operation of the inclined guide surface 14 can be referred to the associated description of Example 2.

It will be appreciated that when the inclined guide surface 14 of the present embodiment employs the structure of the inclined guide surface 14 shown in FIG. 4B, the first groove 133 and the second groove 134 are arranged on the second inclined guide surface 142.

In addition, the embodiment is further provided with baffles, the baffles comprise a middle baffle 1201 arranged on the rear edge 122 of the air duct suction opening 12, a left baffle 1202 connected to the left side of the middle baffle 1201 and a right baffle 1203 connected to the right side of the middle baffle 1201, and the left baffle 1202 and the right baffle 1203 are arranged on the rear edge of the first groove 133 and the rear edge of the second groove 134 respectively. According to the embodiment, the baffles can block raised dust and paper scraps, and the situation that the dust and the paper scraps are diffused to the position behind the air duct suction opening 12 and cannot be sucked into the fresh air duct suction opening 12 is avoided.

Example 4

Figure 6:
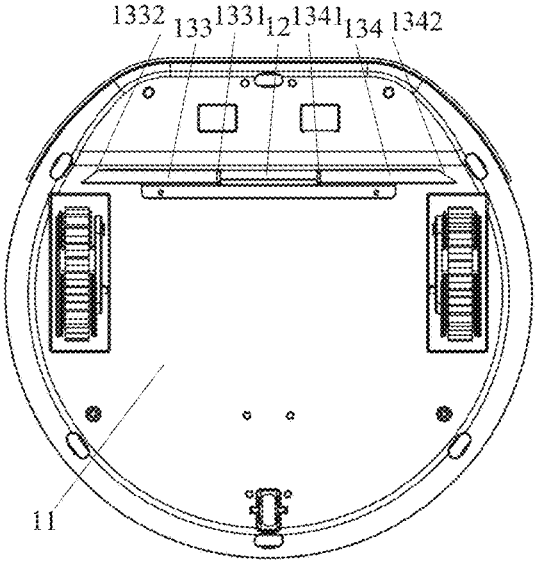
FIG. 6 is a schematic structural view of a dust collection guide structure provided in Example 4 of the present invention.

Referring to FIG. 6, a dust collection guide structure provided by the embodiment of the present invention is arranged at the bottom 11 of the shell 1 of the dust collection mechanism and comprises an air duct suction opening 12 formed in the bottom 11 of the shell 1, and a first groove 133 and a second groove 134 which are formed in the two sides of the air duct suction opening 12. The first groove 133 and the second groove 133 are each communicated with the air duct suction opening 12 to form a dust guide air duct for guiding dust into the air duct suction opening 12.

The structure of the dust collection guide structure provided by the embodiment is substantially the same as that of the dust collection guide structure provided in Example 3, except that the first groove 133 and the second groove 134 of the dust collection guide structure provided by the present embodiment are integrally formed in a straight line (one line), that is, the first groove 133 and the second groove 134 are flush with the air duct suction opening 12, one ends (1331, 1341) of the first groove 133 and the second groove 134 are connected with an air duct suction opening 12 located in the middle front part of the bottom of the shell, and the other ends (1332, 1342) of the first groove 133 and the second groove 134 are in smooth transition connection with the left edge and the right edge, flush with the air duct suction opening, of the bottom of the shell.

It can be understood that the first groove 133 and the second groove 134 of the embodiment can be integrally formed in a splayed shape, and the technical effect to be achieved by the embodiment of the present invention can also be achieved.

Example 5

Figure 7A:
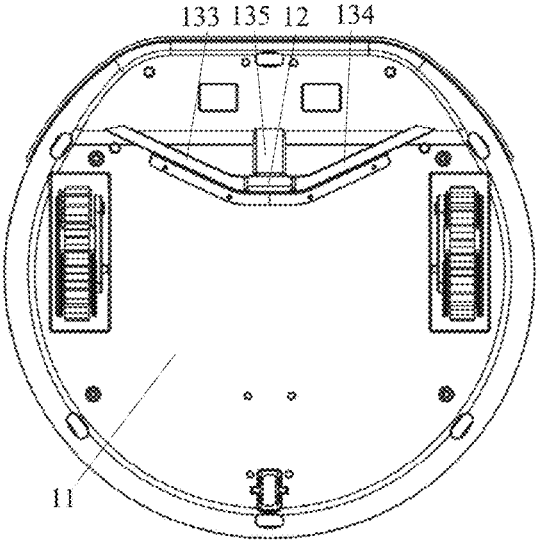
FIGS. 7A-7C are schematic structural views of a dust collection guide structure provided in Example 5 of the present invention.
Figure 7B:
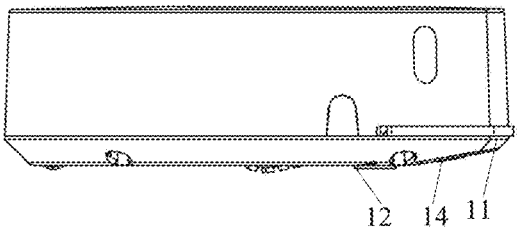
Figure 7C:
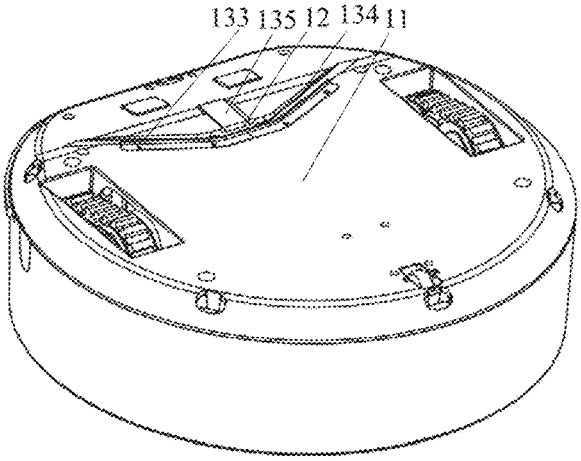

Referring to FIGS. 7A-7C, a dust collection guide structure provided by the embodiment of the present invention is arranged at a bottom 11 of the shell 1 of a dust collection mechanism and comprises an air duct suction opening 12 formed in the bottom 11 of the shell 1, and a first groove 133 and a second groove 134 which are formed in two sides of the air duct suction opening 12. The first groove 133 and the second groove 133 are each communicated with the air duct suction opening 12 to form a dust guide air duct for guiding dust into the air duct suction opening 12. The present embodiment further comprises a third groove 135 formed in the surface of the bottom 11 of the shell 1, the front end of the third groove 135 is in smooth transition connection with the edge of the front end of the bottom 11 of the shell 1, and the rear end of the third groove 135 is connected with the front edge of the air duct suction opening 12.

It can be understood that the dust collection guide structure provided by the present embodiment is a combination of the dust collection guide structures disclosed in Example 2 and Example 3, and three grooves are provided to guide the dust at the front end and on both sides of the air duct suction opening 12 to be sucked into the air duct suction opening 12, so that the dust suction efficiency and effect can be further improved. Other structures and principles of operation of the dust collection guide structure of the present embodiment can be referred to the associated descriptions of Example 2 and Example 3, and are not described herein again.

Example 6

Figure 8A:
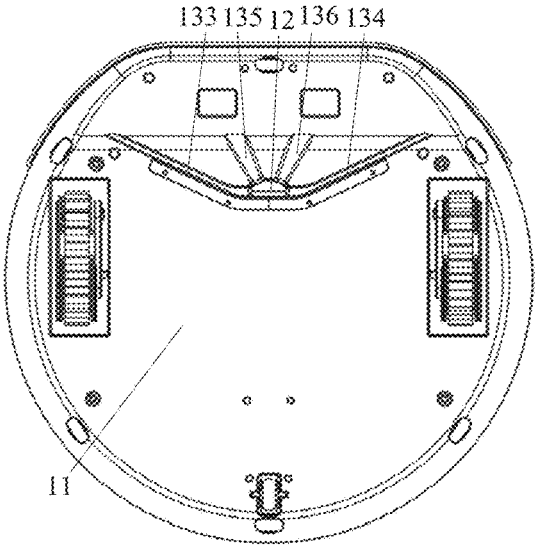
FIGS. 8A-8C are schematic structural views of the dust collection guide structure provided in Example 6 of the present invention.
Figure 8B:
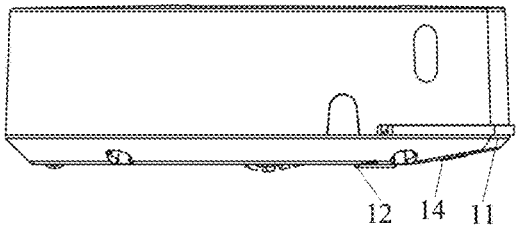
Figure 8C:
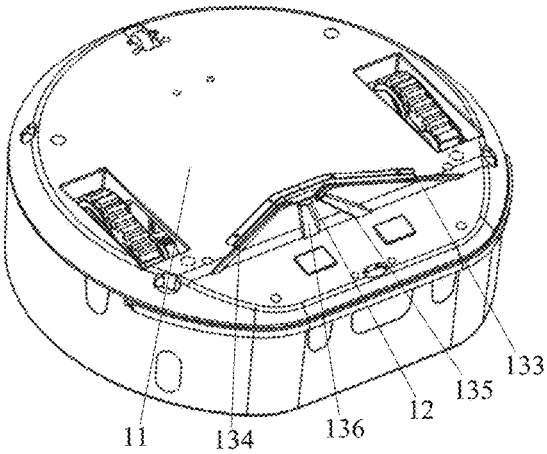

Referring to FIGS. 8A-8C, in a dust suction guiding structure according to the embodiment provided by the present invention, a fourth groove 136 is added on the basis of Example 5, a front end of the fourth groove 136 is in smooth transition connection with the edge of the front end of the bottom 11 of the shell 1, and a rear end of the fourth groove 136 is connected with the front edge of the air duct suction opening 12.

Specifically, the air duct suction opening 12 in the present embodiment is formed in a pentagon shape, and the remaining four edges except the rear edge 122 of the air duct suction opening 12 are each correspondingly connected to one end of one groove. The first groove 133, the second groove 134, the third groove 135 and the fourth groove 136 are integrally arranged in a radial shape at the front end of the surface of the bottom 11 of the shell 1.

According to the present embodiment, four grooves are formed to guide the dust at the front end and on the two sides of the air duct suction opening 12 to be sucked into the air duct suction opening 12, so that the dust suction efficiency and effect can be further improved. Other structures and principles of operation of the dust collection guide structure of the present embodiment can be referred to the associated description of Example 5 and will not be described in detail herein.

It can be understood that the present embodiment adopts a structure of four grooves, and in order to further improve the dust collection effect, five, six or more grooves can also be formed, and the grooves are formed in the front end of the surface of the bottom 11 of the shell 1 in a radial shape.

Example 7

Figure 9:
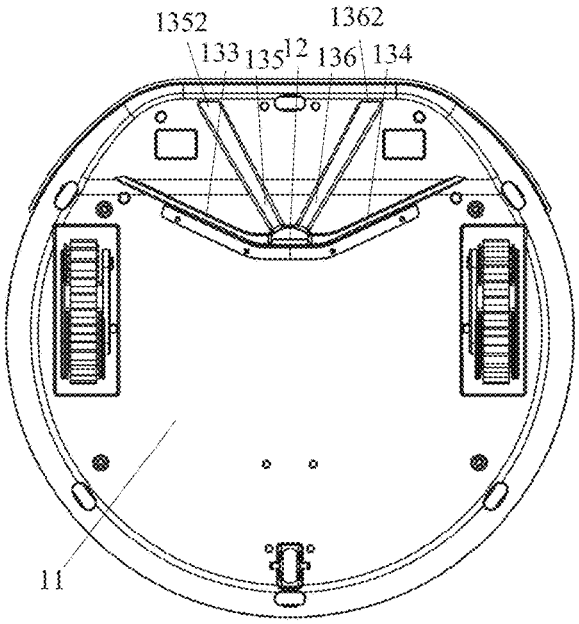
FIG. 9 is a schematic structural view of a dust collection guide structure provided in Example 7 of the present invention.

Referring to FIG. 9, a dust collection guide structure provided in the present embodiment has a design substantially identical to that of the dust collection guide structure of Example 6, except that the other ends (i.e., the front ends) 1352 and 1362 of the third and fourth grooves 135, 136 provided in Example 6 are in smooth transition connection with the rear end of the first inclined guide surface 141, while the other ends (i.e., the front ends) 1352 and 1362 of the third groove 135 and the fourth groove 136 of the dust collection guide structure provided in the present embodiment are in smooth transition connection with the edge of the front end of the bottom 11 of the shell 1, that is, the third groove 135 and the fourth groove 136 of the dust collection guide structure provided in the present embodiment have longer lengths, which is more favorable for guiding dust into the air duct suction opening 12.

Example 8

Figure 10:
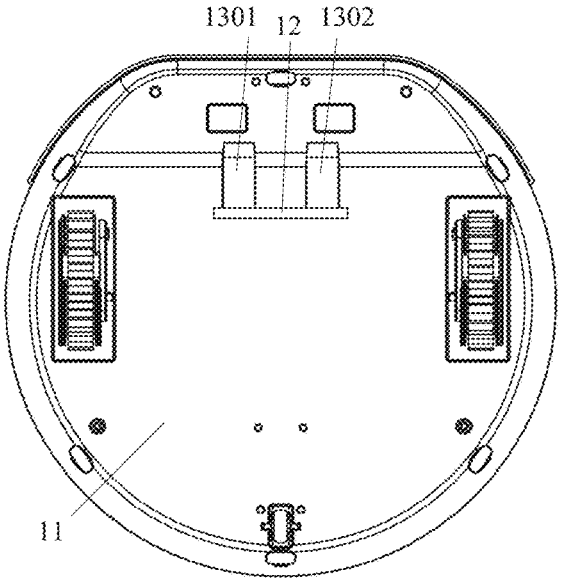
FIG. 10 is a schematic structural view of a dust collection guide structure provided in Example 8 of the present invention.

Referring to FIG. 10, a dust collection guide structure provided in the present embodiment is substantially identical to that of the dust collection guide structure of Example 2, except that the groove formed between the front end of the surface of the bottom 11 of the shell 1 and the air duct suction opening 12 in the present embodiment comprises at least two sub-grooves. For example, in the present embodiment, a first sub-groove 1301 and a second sub-groove 1302 are included, the first sub-groove 1301 and the second sub-groove 1302 are disposed in parallel and each communicate with the air duct suction opening 12 to form a dust guide air duct that guides dust into the air duct suction opening 12.

According to the embodiment, at least two parallel sub-grooves between the front end of the surface of the bottom 11 of the shell 1 and the air duct suction opening 12 are used as dust guide air ducts for guiding dust into the air duct suction opening, so that the dust collection efficiency and effect can be further improved.

It can be understood that the groove formed between the front end of the surface of the bottom 11 of the shell 1 and the air duct suction opening 12 in parallel in the present embodiment can also comprise three or more sub-grooves, and the technical effect to be achieved by the embodiment of the present invention can also be achieved.

Example 9

Figure 11:
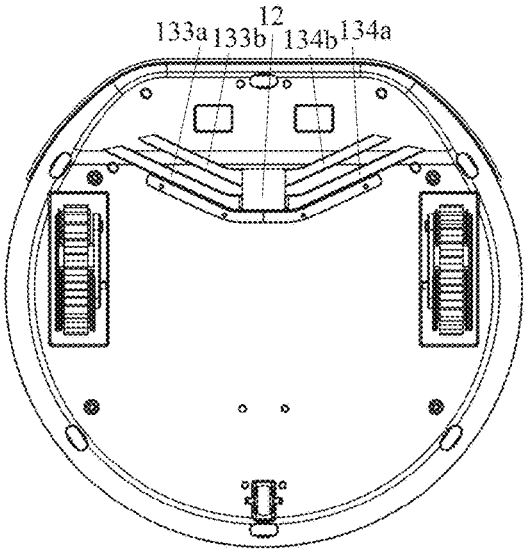
FIG. 11 is a schematic diagram of a dust collection guide structure provided in Example 9 of the present invention.
Figure 12A:
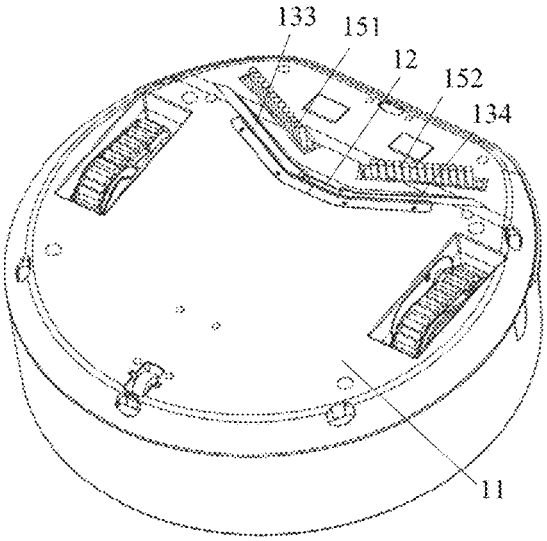
FIGS. 12A-12F are schematic structural views of a sweeping robot and a dust collection guide structure thereof provided in Example 11 of the present invention.
Figure 12B:
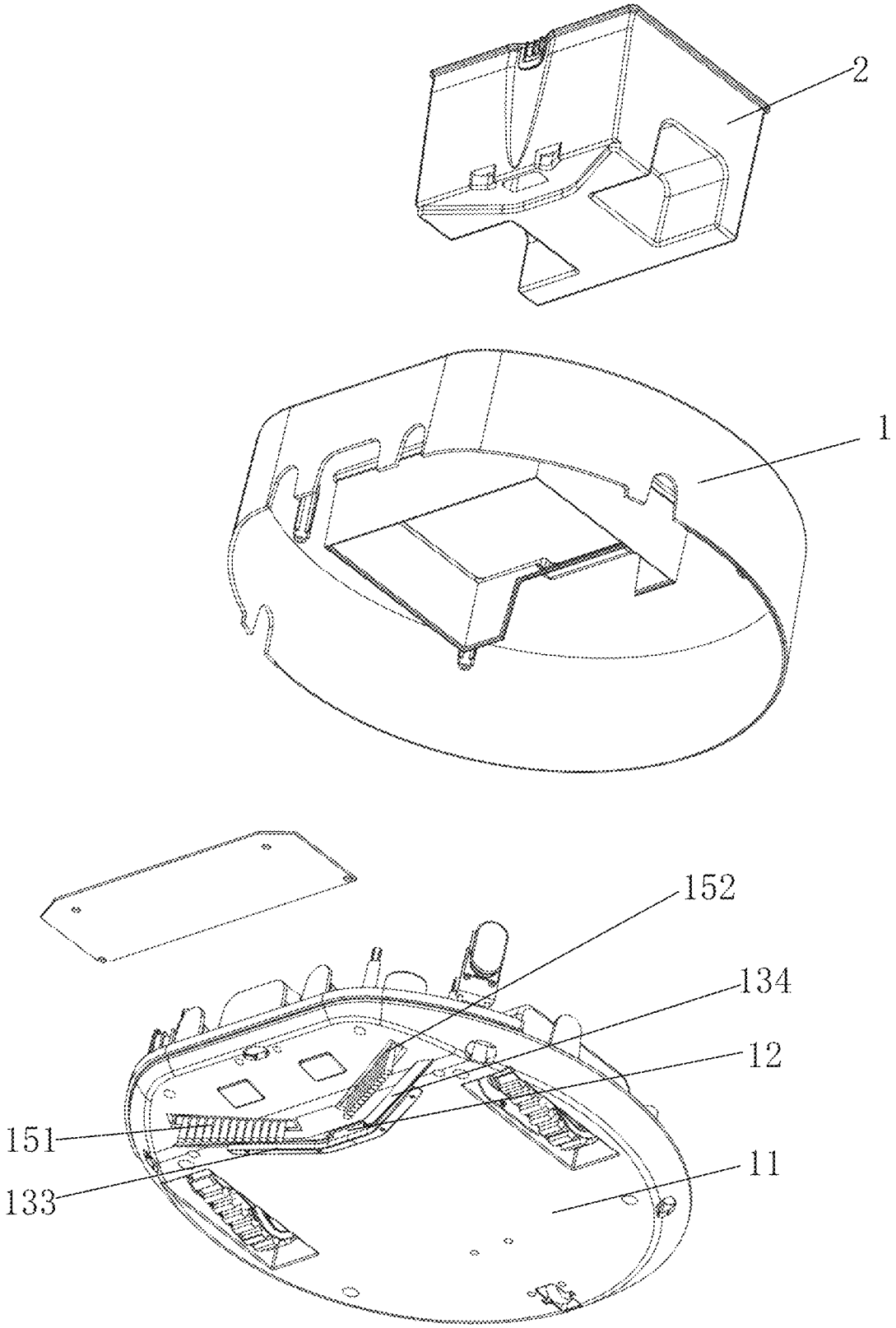
Figure 12C:
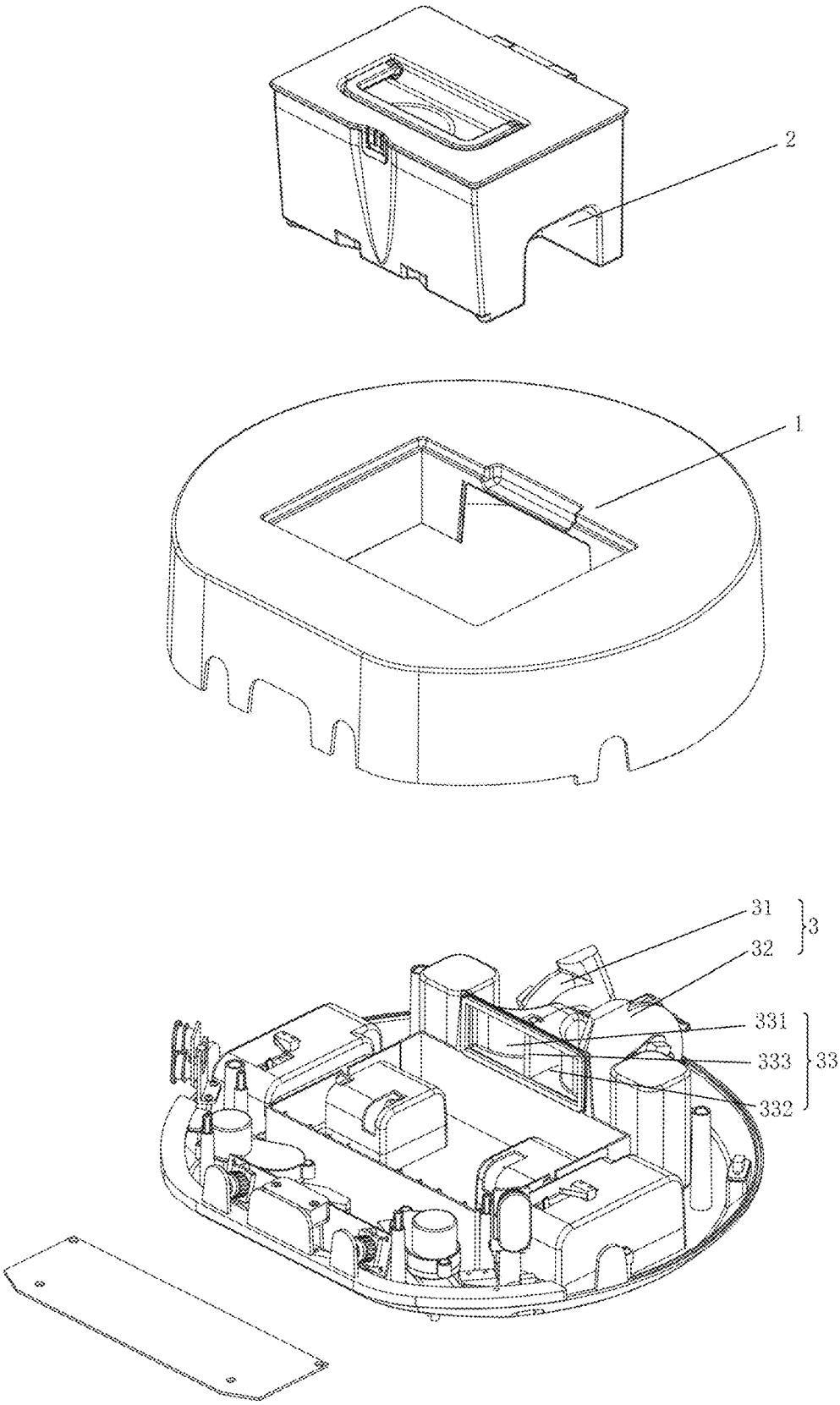
Figure 12D:
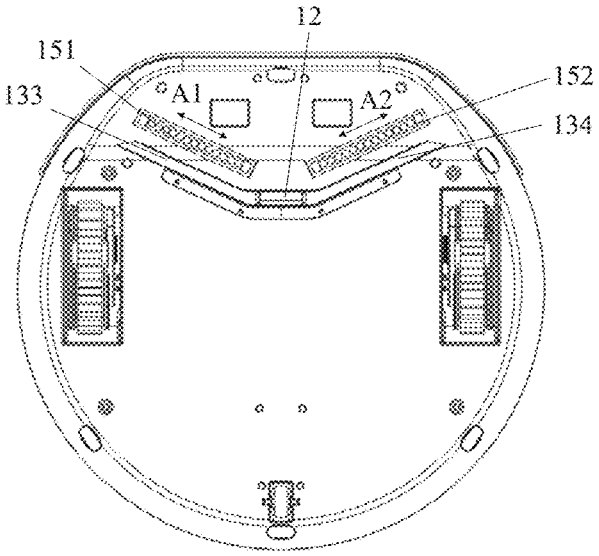
Figure 12E:
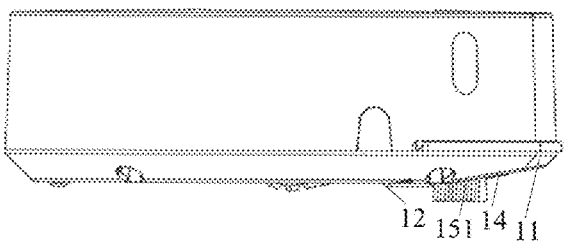
Figure 12F:
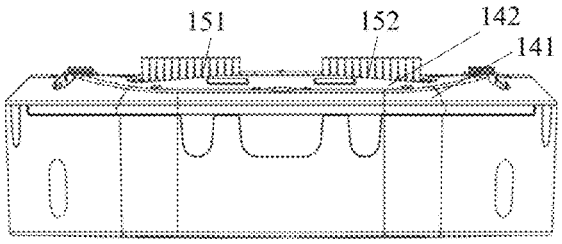

Referring to FIG. 11, a dust collection guide structure provided in the present embodiment is substantially identical to that of the dust collection guide structure of Example 3, except that the first groove and the second groove which are formed in the two sides of the air duct suction opening 12 each comprises at least two sub-grooves. For example, the first groove includes a sub-groove 133*a* and a sub-groove 133*b*, the second trench includes a sub-groove 134*a* and a sub-groove 134*b*, the sub-groove 133*a* and the sub-groove 133*b* are disposed in parallel, and the sub-groove 134*a* and the sub-groove 134*b* are disposed in parallel.

According to the embodiment, at least two sub-grooves are formed in parallel on each side of the two sides of the air duct suction opening 12 to serve as dust guiding air ducts for guiding dust into the air duct suction opening, and therefore the dust suction efficiency and effect can be further improved.

It can be understood that the number of the sub-grooves which are formed in parallel on each side of the two sides of the air duct suction opening 12 in the present embodiment can also be three or more, and the technical effect to be achieved by the embodiment of the present invention can also be achieved.

It can be understood that the at least two sub-grooves formed on each side of the two sides of the air duct suction opening 12 can also be in a radial shape instead of a parallel shape, and the technical effect needing to be achieved by the embodiment of the present invention can also be achieved.

It can be understood that the sub-grooves formed in parallel on each side of the two sides of the air duct suction opening 12 and the air duct suction opening 12 are integrally formed into an inverted splayed shape in the present embodiment, but it can be understood that the sub-grooves and the air duct suction opening 12 can also be integrally formed into a linear shape or a splayed shape, and the effects to be achieved in the embodiment of the present invention can also be achieved.

Example 10

According to a dust collection guide structure provided by the embodiment of the present invention, on the basis of any one of the previous embodiments, at least one sweeping brush is independently arranged at the bottom 11 of the shell 1 and is separated from the air duct suction opening 12.

Each of the at least one sweeping brush can move back and forth integrally when driven so as to sweep and raise dust and paper scraps on the ground. Preferably, each of the at least one sweeping brush is driven to move back and forth integrally close to and away from the air duct suction opening 12. More preferably, each of the at least one sweeping brush is driven to move back and forth integrally between the air duct suction opening 12 and the edge of the bottom 11 of the shell 1.

Preferably, each of the at least one sweeping brush is matched with the groove in the surface of the bottom 11 of the shell 1 so that raised dust can be guided into the air duct suction opening 12 through the groove.

The sweeping brush matched with the groove is arranged at the bottom of the shell, so that dust is raised through the sweeping brush and is guided into the air duct suction opening through the groove, and the dust suction efficiency is improved.

According to the present embodiment of the invention, the sweeping brush which is matched with the groove and is separated from the air duct suction opening independently is arranged at the bottom of the shell, and dust is swept and raised through the sweeping brush and guided into the air duct suction opening through the groove. Therefore, the dust collection efficiency can be improved more effectively, and the problem that the cleaning effect of the dust collection box is influenced due to the fact that the dust collection opening is blocked by winding caused by long-term use of the sweeping brush can be avoided.

Hereinafter, the mating arrangement, specific structure, and principle of operation of each of the at least one sweeping brush with the groove that may be employed will be described in detail by a number of embodiments.

Example 11

Referring to FIGS. 12A-12F, the embodiment of the present invention provides a dust collection guide structure, and on the basis of Example 3, at least one sweeping brush is independently arranged at the bottom 11 of the shell 1 and separated from the air duct suction opening 12.

Specifically, a first sweeping brush 151 and a second sweeping brush 152 are arranged in a matched mode, the first sweeping brush 151 is arranged in front of the first groove 133 and is parallel to the first groove 133, and the second sweeping brush 152 is arranged in front of the second groove 134 and is parallel to the second groove 134.

It will be appreciated that when the inclined guide surface 14 of the present embodiment employs the structure of the inclined guide surface 14 shown in FIG. 4B, the first sweeping brush 151 and the second sweeping brush 152 are preferably provided on the second inclined guide surface 142.

In the present embodiment, it is preferred that the first and second brushes 151, 152 move back and forth in their own axial directions (directions of arrows A1 and A2 in FIG. 12), respectively. That is to say, the first sweeping brush 151 and the second sweeping brush 152 are driven to move back and forth integrally between the air duct suction opening and the edge of the bottom of the shell, and sweep dust at the center and the edge of the sweeper during the moving process. The sweeping brush provided by the embodiment of the present invention can simultaneously serve as the main brush and the side brush in the moving process, so that the sweeping range of the sweeping robot can be enlarged, the cost can be reduced, the main brush, the side brush and the corresponding drivers do not need to be arranged, and the cost is lower.

Referring to FIGS. 13A-13F, the structure of the sweeping brush employed in the present embodiment is shown. The sweeping brush comprises a fixed seat 91 arranged at the bottom 11 of the shell 1, a movable support 92 arranged on the fixed seat 91 and bristles 93 arranged on the movable support 92, and the movable support 92 is driven by a driving component 94 to move relative to the fixed seat 91. Specifically, the movable support 92 is driven by the driving component 94 to move back and forth relative to the fixed seat 91 in the axis direction (shown in the arrow A direction in FIG. 13E) of the movable support 92.

The fixed seat 91 comprises a limiting body 911, and a containing groove 910 is formed in the limiting body 911. The movable support 92 comprises a movable body 921 for containing bristles 93, a driven member 922 is arranged at the bottom of the movable body 921, and the driven member 922 extends out of the containing groove 910 and drives the movable body 921 to move back and forth in the containing groove 910 under the action of the driving component 94. The driving component 94 comprises a motor 941 and a coupling member 942 driven by the motor 941, and the coupling member 942 is connected with the driven member 922 in a matched manner. The motor 941 is preferably a brush direct current motor or a brushless direct current motor, and the coupling member 942 is an eccentric shaft driven by the brush direct current motor or the brushless direct current motor.

Specifically, the movable body 921 reciprocates in the length direction in the containing groove 910. The length of the movable body 921 is smaller than that of the containing groove 910. The movable body 921 further comprises an upper portion 9211 for arranging the bristles 93 and a lower portion 9212 connected with the upper portion 9211, and the driven member 922 is arranged on the bottom surface of the lower portion 9212. The longitudinal section of the movable body 921 along its width direction is in a convex shape. The width of the upper portion 9211 is smaller than that of the containing groove 910 so that the upper portion 9211 can be contained in the containing groove 910, and the width of the lower portion 9212 is larger than that of the containing groove 910.

Figure 13A:
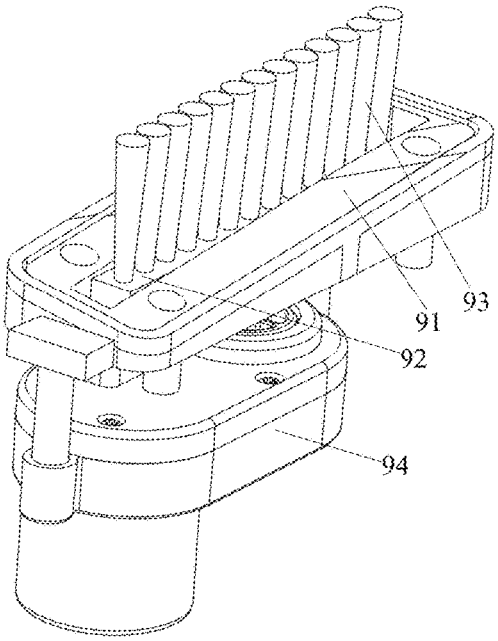
FIGS. 13A-13F are schematic structural views of preferred embodiments of a sweeping brush of the dust collection guide structure provided in Example 11 of the present invention.
Figure 13B:
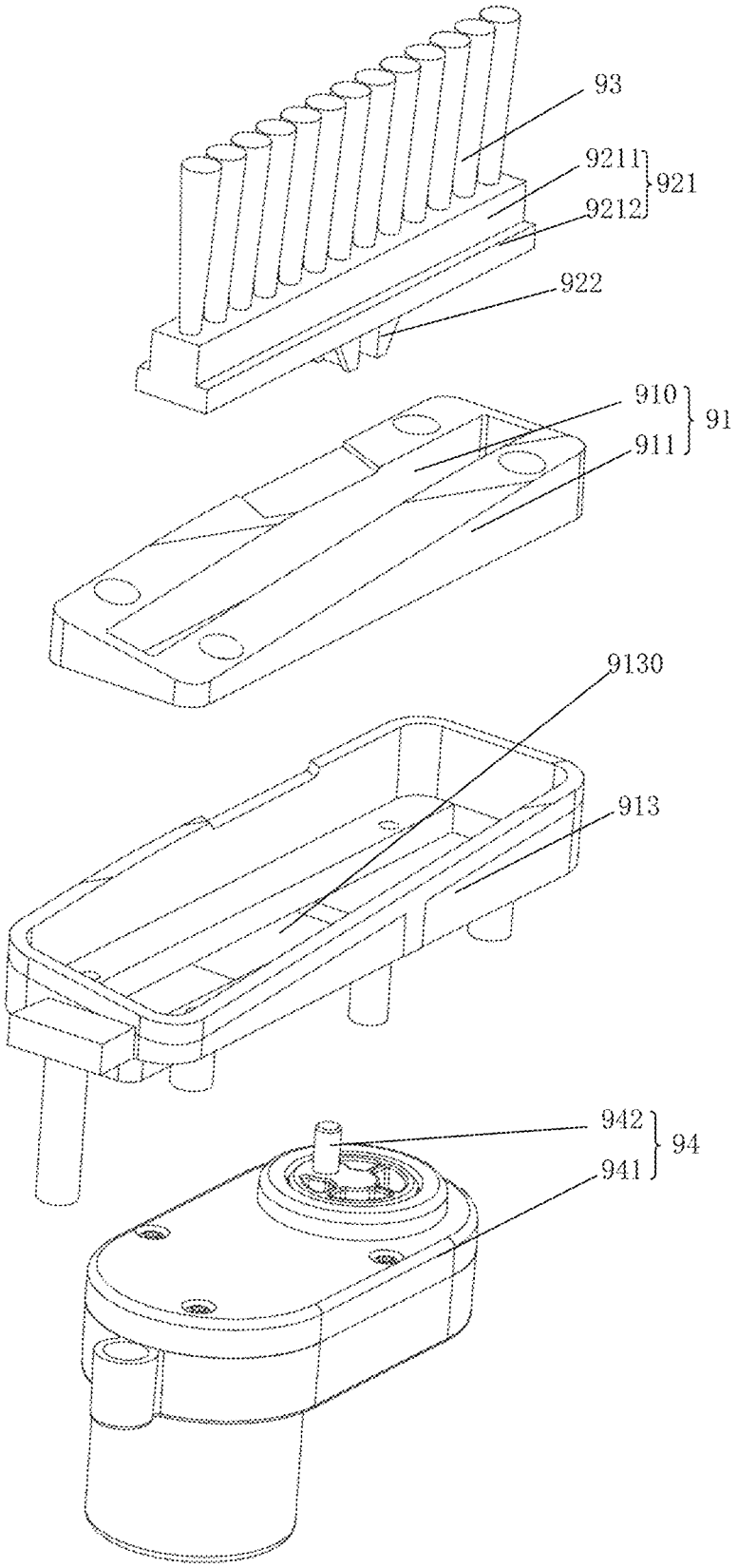
Figure 13C:
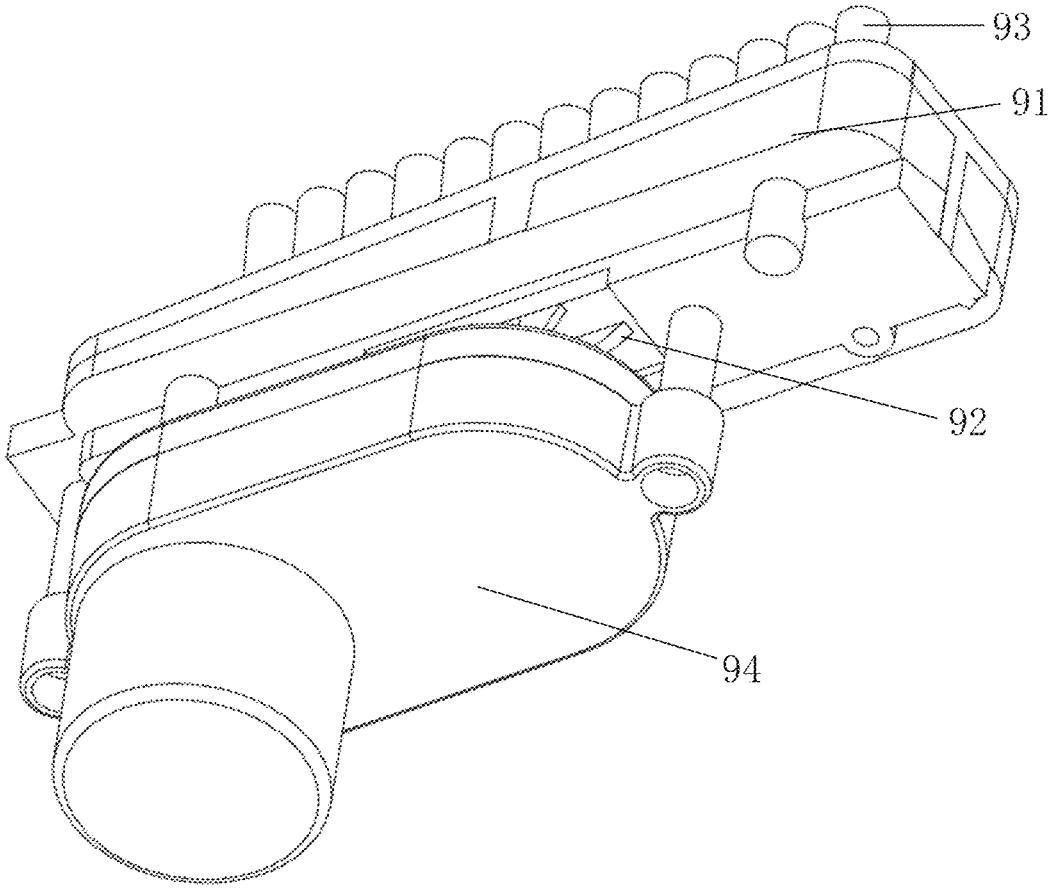
Figure 13D:
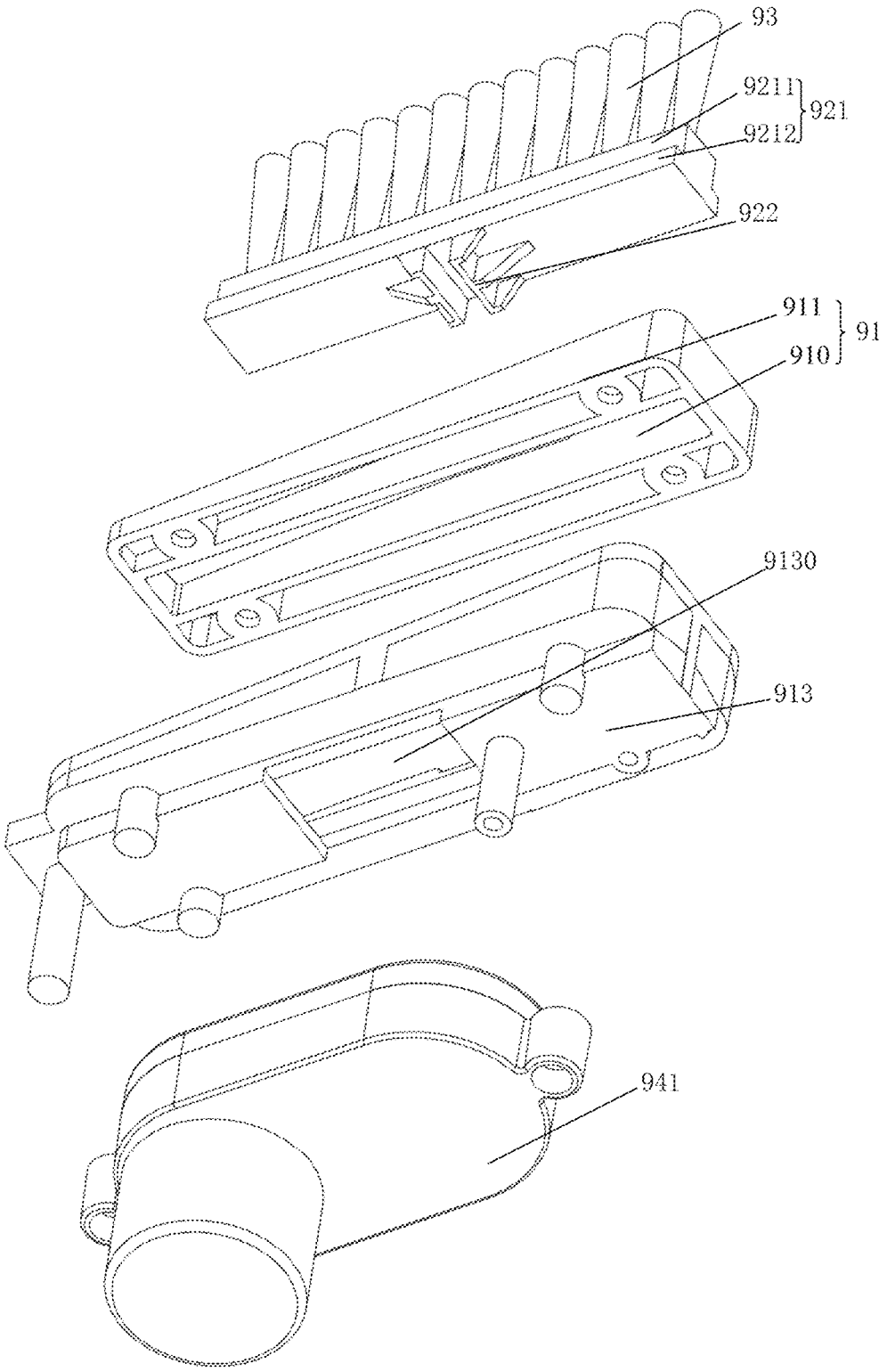
Figure 13E:
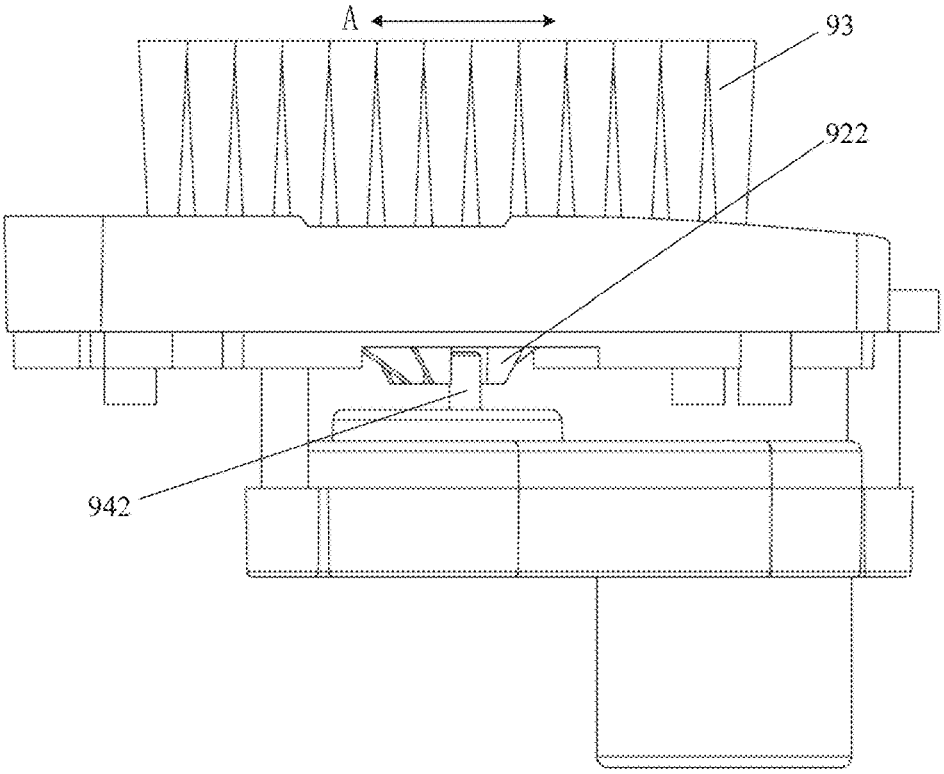
Figure 13F:
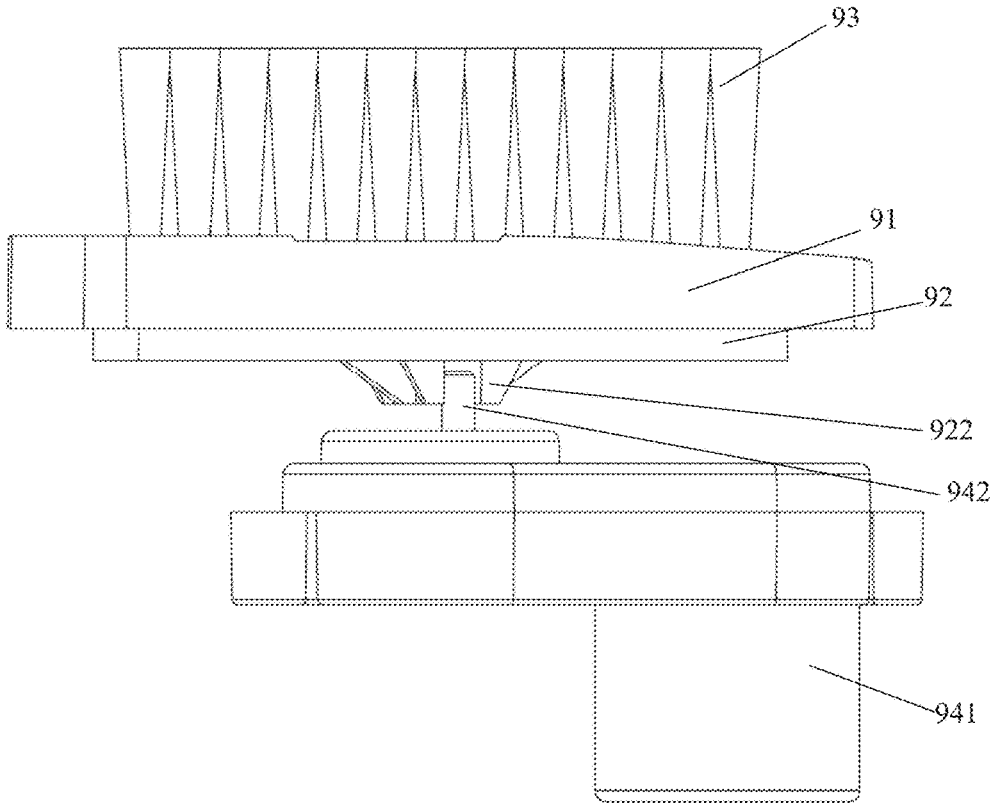

Preferably, the fixed seat 91 of the present embodiment further comprises a bottom case 913, and the limiting body 911 is fixed into the bottom case 913 through a connecting piece (e.g., a screw or the like) so as to prevent the movable body 921 contained in the containing groove 910 from being separated from the limiting body 911. An opening 9130 is formed in the bottom of the bottom case 913 to extend out of the driven member 922. However, it can be understood that the sweeping brush of the present embodiment may not be provided with a bottom case 913, as shown in FIG. 13F, and the implementation effect thereof is not affected.

In specific implementation, the coupling member (eccentric shaft) 942 is driven by the motor to rotate, and in the rotating process, the coupling member (eccentric shaft) 942 is connected with the driven member 922 at the bottom of the movable body 921 in a matched mode to drive the driven member 922 to move, so that the movable body 921 is driven to do reciprocating motion in the length direction in the containing groove 910.

Preferably, in the present embodiment, the bristles 93 are mainly formed by arranging pluralities of bristle bundles. In addition, the movable support 92 provided on each fixed seat 91 include pluralities; and/or the bristles 93 provided on each movable support 92 include pluralities of rows. Each row of the bristles 93 extends out of the surface of the bottom 11 of the shell 1 to abut against the ground. The upper surface of each row of the bristles 93 is in the same horizontal plane to be flush with the ground.

Preferably, in the present embodiment, the movable support 92 is further driven by the driving component 94 to move relative to the fixed seat 91 as follows:

swinging back and forth around the axis of the movable support 92 in the length direction, and the swinging range is 120 degrees; or rotating 360 degrees around the axis of the movable support 92 in the length direction.

In the above-described modification, the sweeping brush is arranged to move back and forth in the length direction of the sweeping brush and can also conduct 120-degree back-and-forth swinging or 360-degree rotating self-motion around the axis in the length direction of the sweeping brush, the sweeping effect can be further improved, and therefore the dust collection effect and efficiency are improved.

Preferably, in the present embodiment, the movable support 92 can also be driven by the driving component 94 to do lifting motion far away from or close to the horizontal plane where the fixed seat is located. According to the improved scheme, the sweeping brush is arranged to be a floating brush, so that the sweeping brush is suitable for uneven grounds, self-adaptive lifting can be carried out according to concave-convex conditions of different grounds, the sweeping brush is tightly attached to the ground to sweep the grounds, and the sweeping effect is guaranteed.

Example 12

Figure 14:
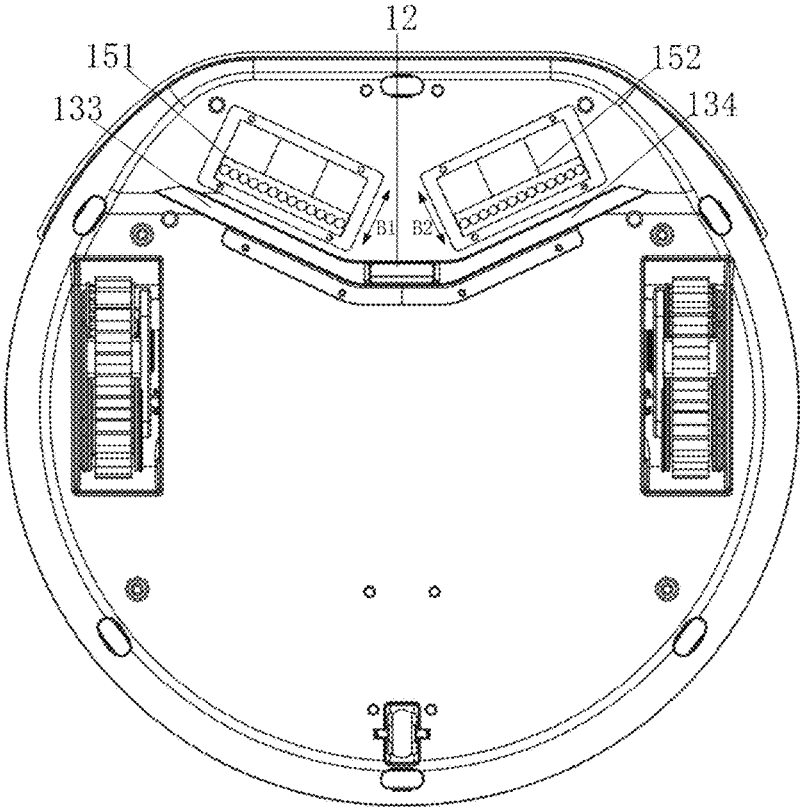
FIG. 14 is a schematic structural view of a dust collection guide structure provided in Example 12 of the present invention.

Referring to FIG. 14, a dust collection guide structure provided by the embodiment of the present invention is substantially the same as that of Example 11, except that the first sweeping brush 151 and the second sweeping brush 152 arranged in the present embodiment are driven to move back and forth in the directions perpendicular to the axes of the first sweeping brush 151 and the second sweeping brush 152 respectively (the directions of arrows B1 and B2 in FIG. 14). That is to say, the first sweeping brush 151 and the second sweeping brush 152 are driven to move back and forth integrally close to and away from the air duct suction opening to conduct sweeping, dust raised during sweeping can be sucked into the air duct suction opening in the moving process, and the sweeping effect and the dust suction effect are improved.

Referring to FIGS. 15A-15F, the structure of the sweeping brush employed in the present embodiment is shown. The sweeping brush comprises a fixed seat 91 arranged at the bottom 11 of the shell 1, a movable support 92 arranged on the fixed seat 91 and bristles 93 arranged on the movable support 92, and the movable support 92 is driven by a driving component 94 to move relative to the fixed seat 91. Specifically, the movable support 92 is driven by the driving component 94 to move back and forth relative to the fixed seat 91 in the axis direction (shown in the arrow B direction in FIG. 15A) of the movable support 92.

The fixed seat 91 comprises a limiting body 911, a containing groove 910 is formed in the limiting body 911, the movable support 92 comprises a movable body 921 for containing the bristles 93, a driven member 922 is arranged at the bottom of the movable body 921, and the driven member 922 extends out of the containing groove 910 and drives the movable body 921 to move back and forth in the containing groove 910 under the action of the driving component 94. The driving component 94 comprises a motor 941 and a coupling member 942 driven by the motor 941, and the coupling member 942 is connected with the driven member 922 in a matched mode. The motor 941 is preferably a brush direct current motor or a brushless direct current motor, and the coupling member 942 is an eccentric shaft driven by the brush direct current motor or the brushless direct current motor.

Specifically, the movable body 921 reciprocates in the width direction in the containing groove 910. The width of the movable body 921 is smaller than that of the containing groove 910. The movable body 921 comprises an upper portion 9211 for arranging the bristles 93 and a lower portion 9212 connected with the upper portion 9211, and the driven member 922 is arranged on the bottom surface of the lower portion 9212. The longitudinal section of the movable body 921 in the length direction of the movable body 921 is in a convex shape. The length of the upper portion 9211 is smaller than that of the containing groove 910 so that the upper portion 9211 can be contained in the containing groove 910, and the length of the lower portion 9212 is larger than that of the containing groove 910.

Figure 15A:
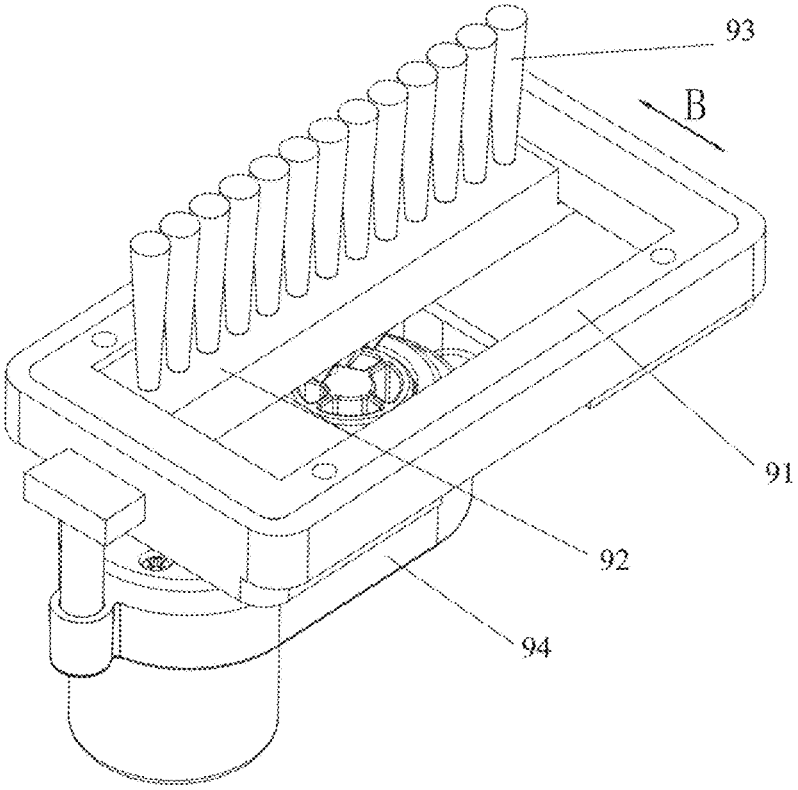
FIGS. 15A-15F are schematic structural views of preferred embodiments of a sweeping brush of the dust collection guide structure provided in Example 12 of the present invention.
Figure 15B:
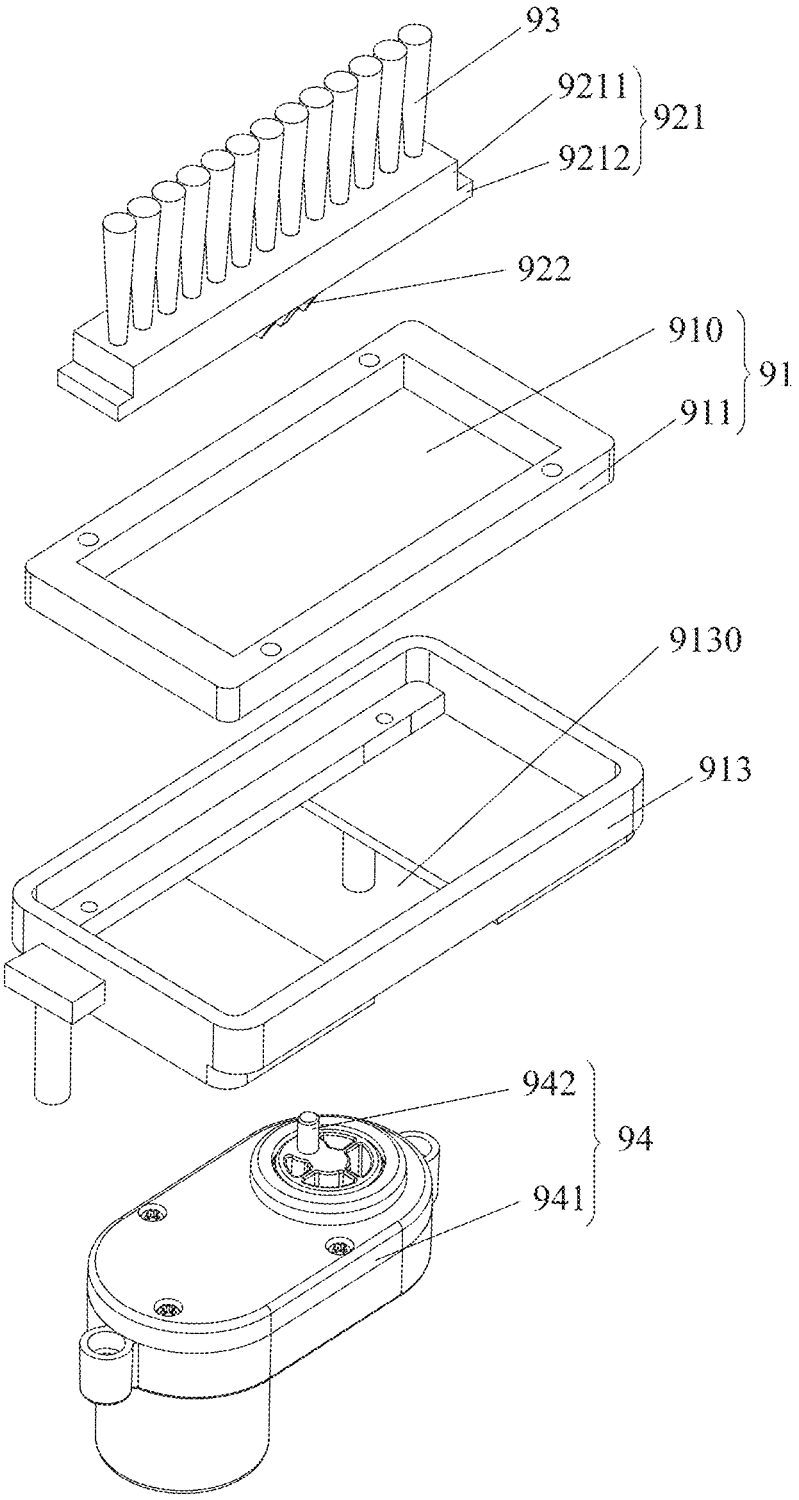
Figure 15C:
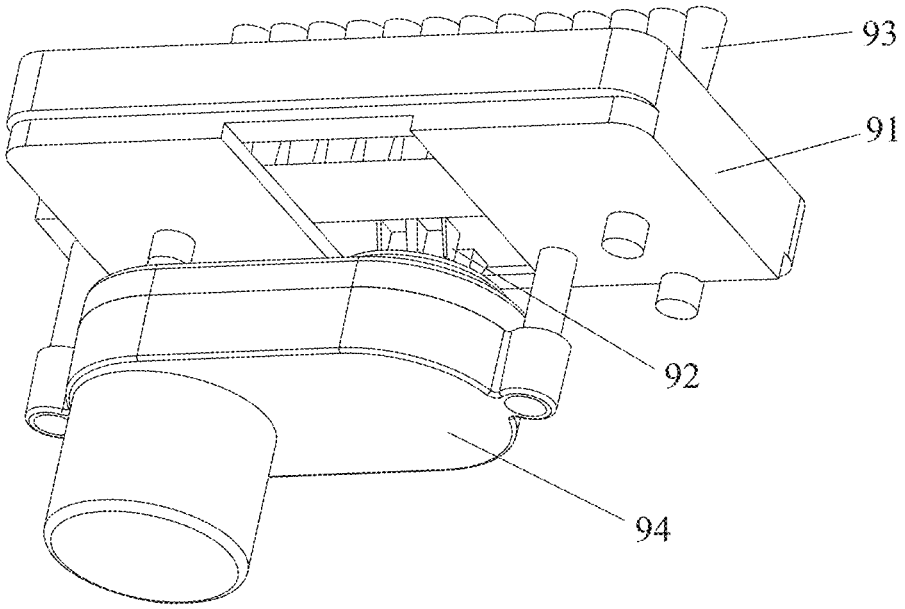
Figure 15D:
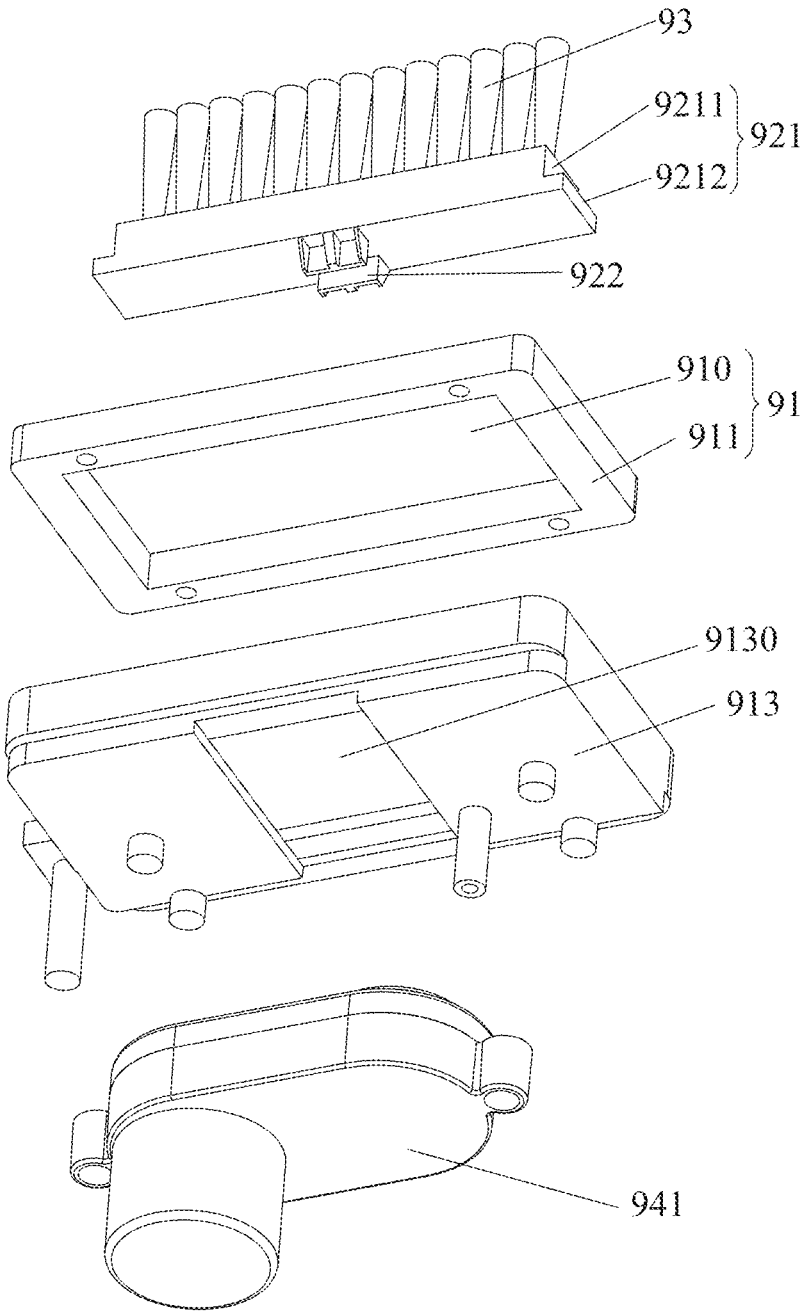
Figure 15E:
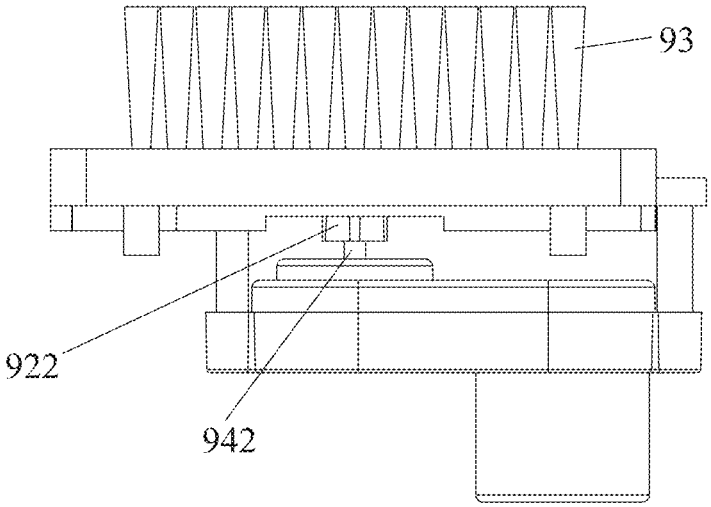
Figure 15F:
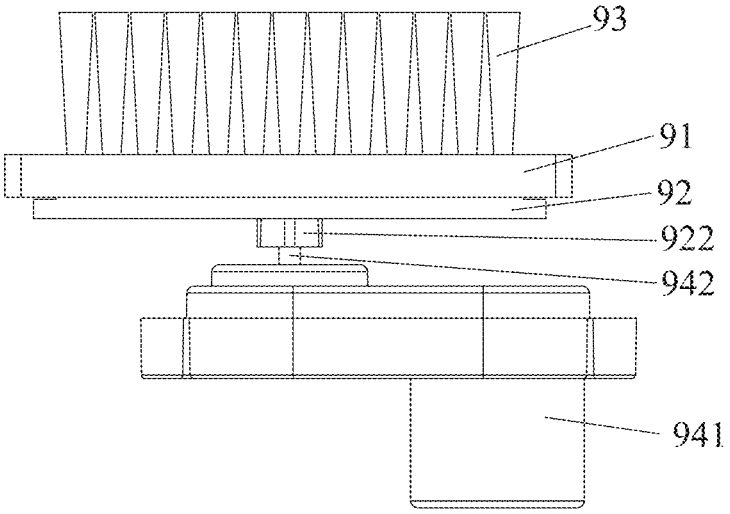

Preferably, the fixed seat 91 of the present embodiment further comprises a bottom case 913, and the limiting body 911 is fixed into the bottom case 913 through a connecting piece (e.g., a screw or the like) so as to prevent the movable body 921 contained in the containing groove 910 from being separated from the limiting body 911. An opening 9130 is formed in the bottom of the bottom case 913 to extend out of the driven member 922. However, it can be understood that the sweeping brush of the present embodiment may not be provided with a bottom case 913, as shown in FIG. 15F, and the implementation effect thereof is not affected.

In specific implementation, the coupling member (eccentric shaft) 942 is driven by the motor to rotate, and in the rotating process, the coupling member (eccentric shaft) 942 is connected with the driven member 922 at the bottom of the movable body 921 in a matched mode to drive the driven member 922 to move, so that the movable body 921 is driven to do reciprocating motion in the width direction in the containing groove 910.

Example 13

Figure 16:
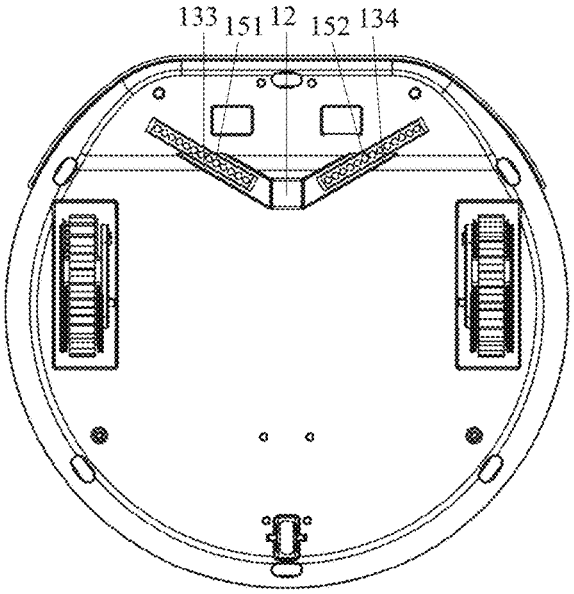
FIG. 16 is a schematic structural view of a dust collection guide structure provided in Example 13 of the present invention.

Referring to FIG. 16, the embodiment of the present invention provides a dust collection guide structure, and on the basis of Example 3, at least one sweeping brush is independently arranged at the bottom 11 of the shell 1 and separated from the air duct suction opening 12. Specifically, a first sweeping brush 151 and a second sweeping brush 152 are arranged in a matched mode, the first sweeping brush 151 is arranged on the first groove 133, and the second sweeping brush 152 is arranged on the second groove 133.

The first and second sweeping brushes 151, 152 are arranged to move back and forth in their own axial directions, and the specific constructions and principles can be referred to Example 11.

Example 14

Figure 17:
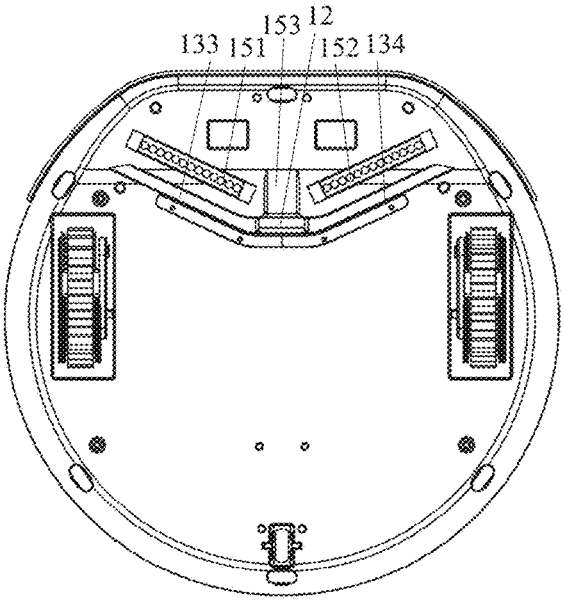
FIG. 17 is a schematic structural view of a dust collection guide structure provided in Example 14 of the present invention.

Referring to FIG. 17, the embodiment of the present invention provides a dust collection guide structure, and on the basis of Example 5, at least one sweeping brush is independently arranged at the bottom 11 of the shell 1 and separated from the air duct suction opening 12. Specifically, a first sweeping brush 151 and a second sweeping brush 152 are arranged in a matched mode, and the first sweeping brush 151 and the second sweeping brush 152 are arranged in front of the first groove 133 and the second groove 134 respectively and arranged on two sides of the third groove 135. The first sweeping brush 151 is arranged in parallel with the first groove 133, and the second sweeping brush 152 is arranged in parallel with the second groove 134.

The first sweeping brush 151 and the second sweeping brush 152 can be arranged to move back and forth in their own axial directions or move back and forth in the directions perpendicular to their own axes. Reference may be made to Example 11 and Example 12 described above for specific constructions and principles.

In addition, the improved structure of the first sweeping brush 151 and the second sweeping brush 152 of the present embodiment is also referred to the related descriptions of Example 11 and Example 12 described above, and will not be described in detail herein.

Example 15

Figure 18:
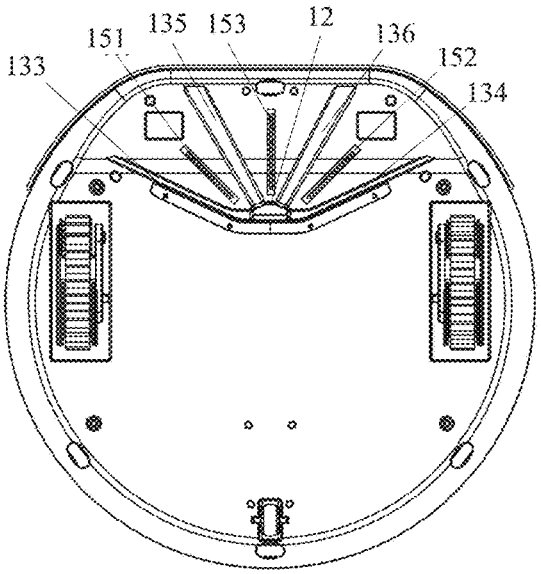
FIG. 18 is a schematic structural view of a dust collection guide structure provided in Example 15 of the present invention.

With reference to FIG. 18, the embodiment of the present invention provides a dust collection guide structure, and on the basis of Example 6 or Example 7, at least one sweeping brush is independently arranged at the bottom 11 of the shell 1 and separated from the air duct suction opening 12. Specifically, a first sweeping brush 151, a second sweeping brush 152 and a third sweeping brush 153 are arranged in a matched mode, and the first sweeping brush 151, the second sweeping brush 152 and the third sweeping brush 153 are integrally disposed at the front end of the surface of the bottom 11 of the shell 1 in a radial shape and are spaced apart from the first groove 133, the second groove 134, the third groove 135, and the fourth groove 136.

The first sweeping brush 151, the second sweeping brush 152 and the third sweeping brush 153 can be arranged to move back and forth in their own axis directions or move back and forth in the directions perpendicular to their own axes. Reference may be made to Example 11 and Example 12 described above for specific constructions and principles.

In addition, the improved structure of the first, second, and third sweeping brushes 151, 152, 153 of the present embodiment is also described with reference to the related description of Examples 11 and 12 described above, and will not be described in detail herein.

Example 16

Figure 19:
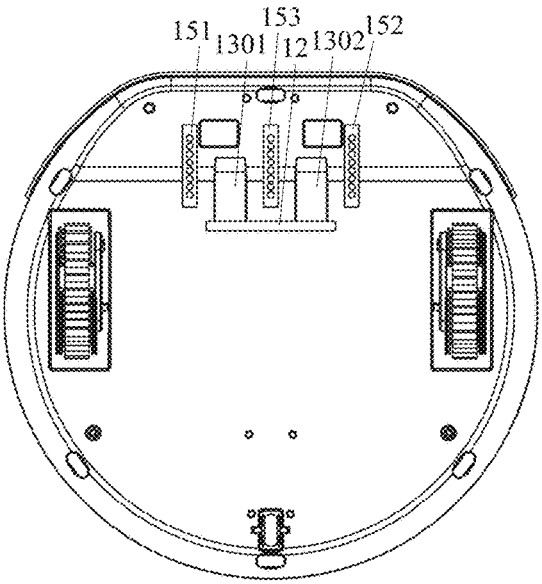
FIG. 19 is a schematic structural view of a dust collection guide structure provided in Example 16 of the present invention.

Referring to FIG. 19, the embodiment of the present invention provides a dust collection guide structure, and on the basis of Example 8, at least one sweeping brush is independently arranged at the bottom 11 of the shell 1 and separated from the air duct suction opening 12. Specifically, a first sweeping brush 151, a second sweeping brush 152 and a third sweeping brush 153 are arranged in a matched mode, and the first sweeping brush 151, the second sweeping brush 152 and the third sweeping brush 153 are arranged between the front end of the surface of the bottom 11 of the shell 1 and the air duct suction opening 12 and are parallel to the first sub-groove 1301 and the second sub-groove 1302 alternately.

The first sweeping brush 151, the second sweeping brush 152 and the third sweeping brush 153 can be arranged to move back and forth in their own axis directions or move back and forth in the directions perpendicular to their own axes. Reference may be made to Example 11 and Example 12 described above for specific constructions and principles.

In addition, the improved structure of the first, second, and third sweeping brushes 151, 152, 153 of the present embodiment is also described with reference to the related description of Examples 11 and 12 described above, and will not be described in detail herein.

Example 17

Figure 20:
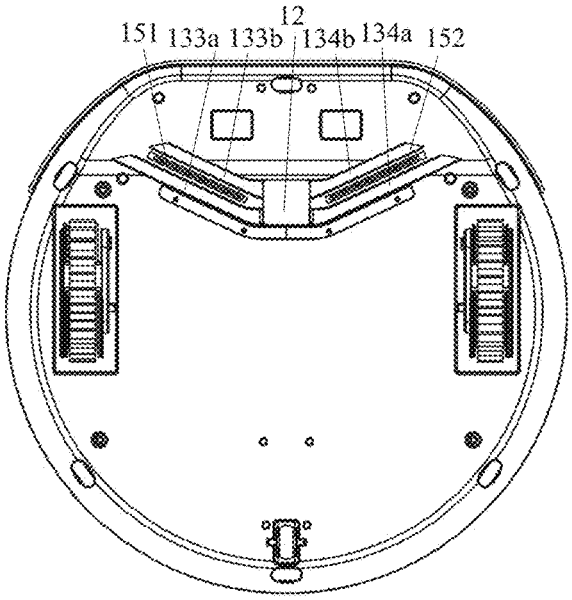
FIG. 20 is a schematic structural view of a dust collection guide structure provided in Example 17 of the present invention.

Referring to FIG. 20, the embodiment of the present invention provides a dust collection guide structure, and on the basis of Example 9, at least one sweeping brush is independently arranged at the bottom 11 of the shell 1 and separated from the air duct suction opening 12. Specifically, a first sweeping brush 151 and a second sweeping brush 152 are arranged in a matched mode, the first sweeping brush 151 is arranged between the sub-groove 133*a* and the sub-groove 133*b* and is parallel to the sub-groove 133*a* and the sub-groove 133*b*, and the second sweeping brush 152 is arranged between the sub-groove 134*a* and the sub-groove 134*b* and is parallel to the sub-groove 134*a* and the sub-groove 134*b*.

The first sweeping brush 151 and the second sweeping brush 152 can be arranged to move back and forth in their own axis directions or move back and forth in the directions perpendicular to their own axes. Reference may be made to Example 11 and Example 12 described above for specific constructions and principles.

In addition, the improved structure of the first sweeping brush 151 and the second sweeping brush 152 of the present embodiment is also referred to the related descriptions of Examples 11 and 12 described above, and will not be described in detail herein.

Example 18

Figure 21:
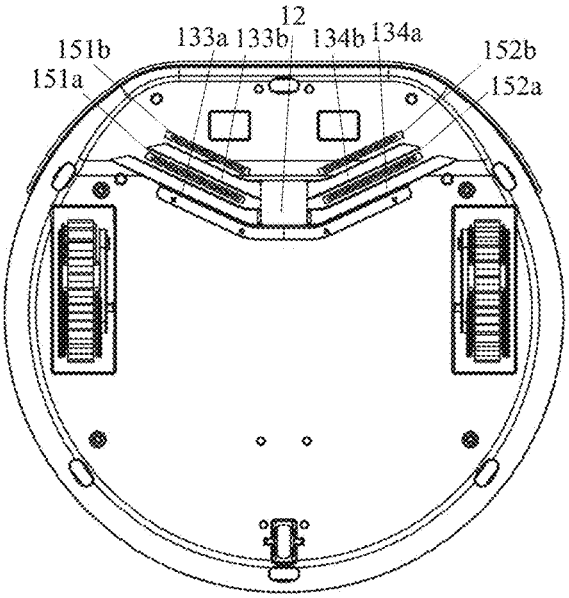
FIG. 21 is a schematic structural view of a dust collection guide structure provided in Example 18 of the present invention.
Figure 22A:
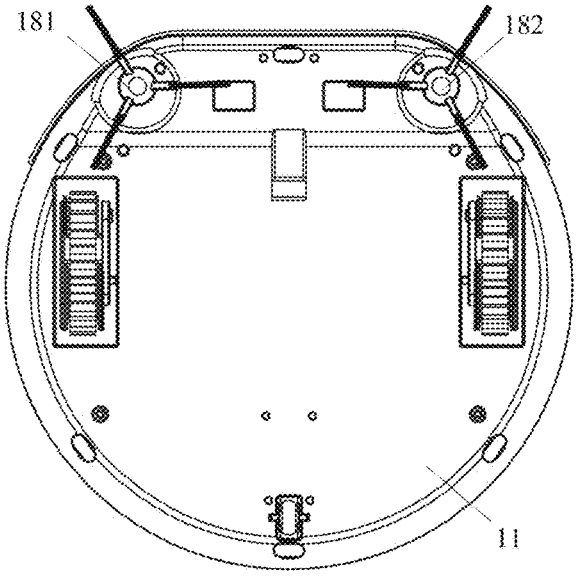
FIGS. 22A-22H are schematic structural views of a dust collection guide structure provided in Example 19 of the present invention.
Figure 22B:
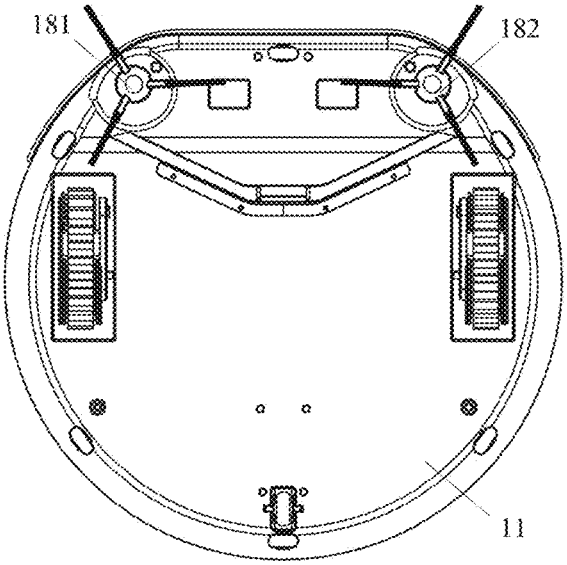
Figure 22C:
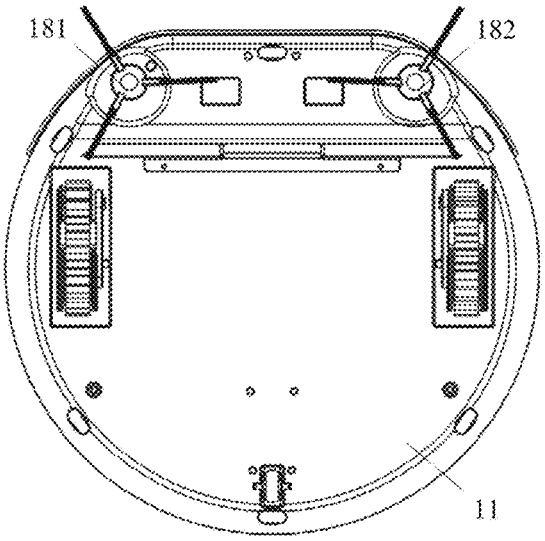
Figure 22D:
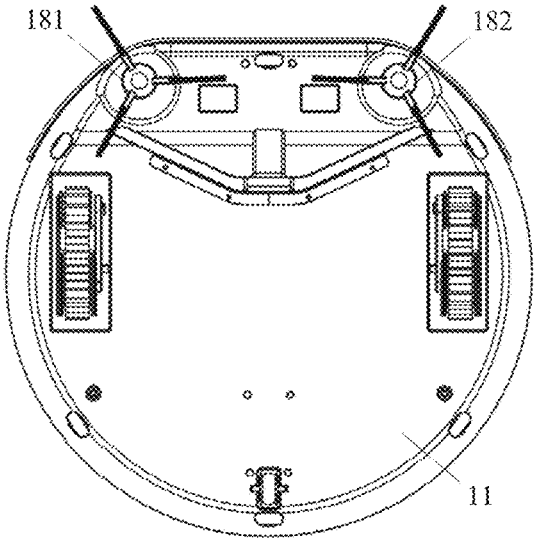
Figure 22E:
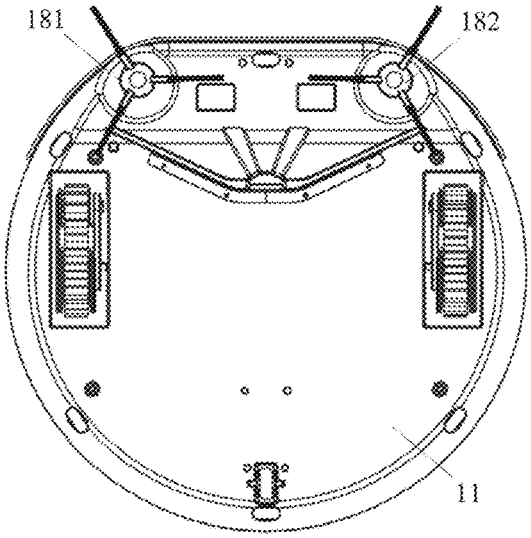
Figure 22F:
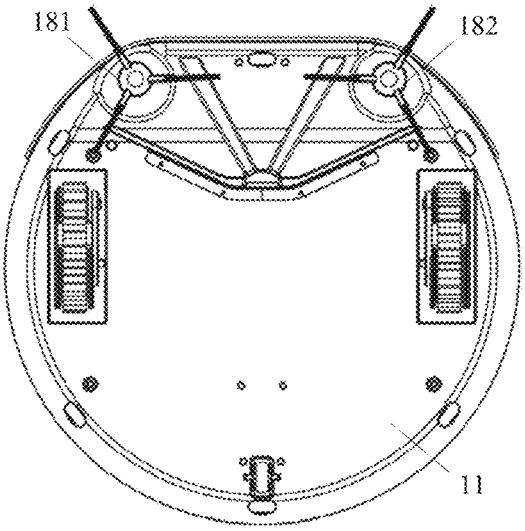
Figure 22G:
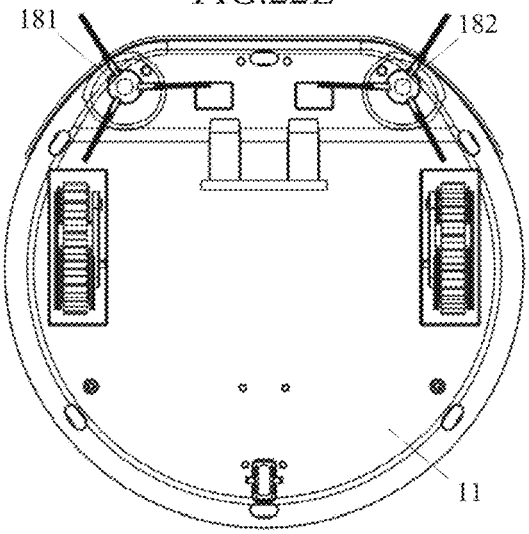
Figure 22H:
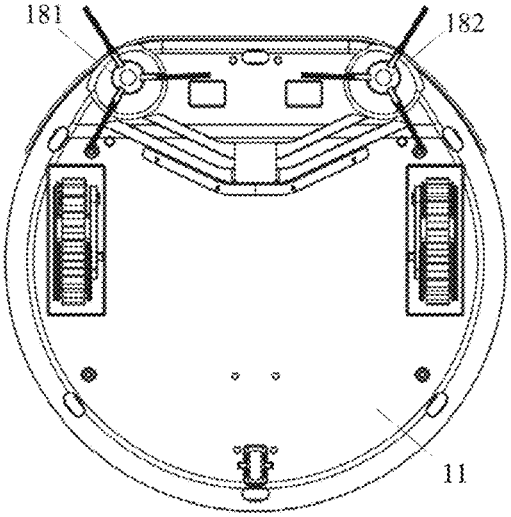

Referring to FIG. 21, the embodiment of the present invention provides a dust collection guide structure, and on the basis of Example 9, at least one sweeping brush is independently arranged at the bottom 11 of the shell 1 and separated from the air duct suction opening 12. Specifically, a sweeping sub-brush 151*a* and a sweeping sub-brush 151*b* which are arranged in parallel and a sweeping sub-brush 152*a* and a sweeping sub-brush 152*b* which are arranged in parallel are arranged in a matched mode. The sweeping sub-brush 151*a* and the sweeping sub-brush 151*b* are respectively arranged in front of the sub-groove 133*a* and the sub-groove 133*b* and are parallel to the sub-groove 133*a* and the sub-groove 133*b* alternately. The sweeping sub-brushes 152*a* and 152*b* are respectively arranged in front of the sub-groove 134*a* and the sub-groove 134*b* and are parallel to the sub-groove 134*a* and the sub-groove 134*b* alternately.

The sweeping sub-brushes 151*a*, 151*b*, 152*a* and 152*b* can be arranged to move back and forth in their own axis directions or move back and forth in the directions perpendicular to their own axes. Reference may be made to Example 11 and Example 12 described above for specific constructions and principles.

In addition, the improved structure of the sweeping sub-brush 151*a*, the sweeping sub-brush 151*b*, the sweeping sub-brush 152*a* and the sweeping sub-brush 152*b* of the embodiment are also referred to the related description of Example 11 and Example 12, and will not be described in detail herein.

Example 19

The embodiment of the present invention provides a dust collection guide structure, on the basis of any one embodiment, at least one corner of the front end of the bottom of the shell is provided with a side brush, and the side brush is driven by a driving device to rotate. Preferably, the side brush is a three-blade type rotary side brush.

Referring to FIGS. 22A-22H, on the basis of the Examples 2-9 described above, at least one corner of the front end of the bottom 11 of the shell 1 is provided with a side brush, and the side brush is driven by a drive device to rotate.

Specifically, a first side brush 181 is arranged at the upper left corner of the front end of the bottom 11 of the shell 1, a second side brush 182 is arranged at the upper right corner of the front end of the bottom 11 of the shell 1, and the first side brush 181 and the second side brush 182 are preferably three-blade type rotary side brushes.

Therefore, according to the embodiment, by arranging at least one groove in the surface of the bottom of the shell and being matched with the rotary side brushes arranging on at least one corner (preferably the left corner and the right corner) of the front end of the bottom of the shell, the problem that the sweeping effect of the dust collection box is affected due to the fact that the air suction opening is blocked by winding of the rolling main brush arranged on the air suction opening can be effectively avoided, dust raised by the side brush can be guided into the air duct suction opening through the groove, and the dust suction efficiency is improved, and particularly, the sweeping and cleaning effects on corners are very ideal.

It can be understood that a rotary side brush can also be arranged on at least one corner (preferably the left corner and the right corner) of the front end of the bottom of the shell on the basis of the Examples 10-18, and the bristles of the rotary side brush do not interfere with the sweeping brush and the like in the moving process through the arrangement of the rotary side brush.

Specifically, the lengths of bristles of the first side brush 181 and the second side brush 182 are set so that the first side brush 181 and the second side brush 182 cannot interfere with the sweeping brush and the like in the rotating process.

Therefore, according to the embodiment of the present invention, by arranging at least one groove in the surface of the bottom of the shell, arranging the sweeping brush 15 which is separated from and independently arranged from the air duct suction opening near the center of the bottom of the shell so as to sweep and raise dust, and arranging the first side brush 181 and the second side brush 182 which rotate on the left corner and the right corner of the front end of the bottom of the shell, the dust at the center and the edge of the sweeper can be effectively swept, the sweeping and cleaning effects are particularly ideal, and the sweeping efficiency and effect are effectively improved.

The foregoing is a preferred embodiments of the present invention and it should be noted that several improvements and modifications may also be made to those of ordinary skill in the art without departing from the principles of the present invention, which are also considered to be within the scope of the present invention.

What is claimed is:

1. A dust collection guide structure arranged at a bottom of a shell of a dust collection mechanism, comprising an air duct suction opening formed in the bottom of the shell, at least two grooves formed in a surface of the bottom of the shell and at least two sweeping brushes independently arranged at the bottom of the shell and separated from the air duct suction opening, each of the at least two grooves is communicated with the air duct suction opening to form a dust guide air duct for guiding dust into the air duct suction opening, and the at least two sweeping brushes is matched with the at least two grooves so as to facilitate guiding raised dust into the air duct suction opening through the at least two grooves; the at least two grooves formed in the surface of the bottom of the shell comprise a first groove and a second groove which are formed in two sides of the air duct suction opening respectively, and the at least two sweeping brushes arranged at the bottom of the shell comprise a first sweeping brush and a second sweeping brush which are arranged in front of the first groove and the second groove respectively; wherein the first sweeping brush is disposed parallel to the first groove and the second sweeping brush is disposed parallel to the second groove; the first groove and the second groove are integrally formed into a straight line, a splayed shape, or an inverted splayed shape.

2. The dust collection guide structure according to claim 1, wherein one end of each of the at least two grooves is connected with the air duct suction opening and an other end of each of the at least two grooves is in smooth transition connection with an edge of the bottom of the shell.

3. The dust collection guide structure according to claim 1, wherein each of the at least two sweeping brushes is driven to move back and forth integrally close to and away from the air duct suction opening.

4. The dust collection guide structure according to claim 1, wherein the air duct suction opening is formed in a central axis of the bottom of the shell, and a distance between the air duct suction opening and a front end of the bottom of the shell is smaller than a distance between the air duct suction opening and a rear end of the bottom of the shell; a depth of each of the at least two grooves is gradually increased from one end away from the air duct suction opening to the other end connected with the air duct suction opening.

5. A dust collection mechanism, comprising the dust collection guide structure according to claim 1, and further comprising a dust collection box and a draught fan which are arranged inside the shell, and the air duct suction opening, the dust collection box and the draught fan are sequentially communicated.

6. The dust collection mechanism according to claim 5, wherein the draught fan comprises a first draught fan and a second draught fan, and the first draught fan and the second draught fan communicate with the dust collection box through an air suction guide component; the air suction guide component comprises a first air suction channel and a second air suction channel which are independent of each other, the first draught fan is communicated with the first air suction channel, and the second draught fan is communicated with the second air suction channel.

7. A sweeping robot, comprising the dust collection mechanism according to claim 5.

8. The dust collection guide structure according to claim 1, wherein each of the at least two sweeping brushes moves back and forth in a direction of an axis thereof.

9. The dust collection guide structure according to claim 1, wherein an inclined guide surface is arranged at a front end of the bottom of the shell, and a front or rear edge of the air duct suction opening abuts a rear end of the inclined guide surface;

the inclined guide surface is a curved surface, and the angle between the inclined guide surface and a horizontal plane gradually decreases from the front end to the rear end of the inclined guide surface.

* * * * *